US007178473B2

(12) United States Patent
Mizuno et al.

(10) Patent No.: US 7,178,473 B2
(45) Date of Patent: Feb. 20, 2007

(54) SEWING MACHINE WITH AUTOMATIC THREADING APPARATUS

(75) Inventors: Noboru Mizuno, Nagoya (JP); Shinya Fujihara, Nagoya (JP); Hiroshi Yamasaki, Nagoya (JP); Yoshiyuki Uyama, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/140,920

(22) Filed: Jun. 1, 2005

(65) Prior Publication Data

US 2005/0268830 A1 Dec. 8, 2005

(30) Foreign Application Priority Data

Jun. 2, 2004 (JP) ..... 2004-164454

(51) Int. Cl.
*D05B 87/02* (2006.01)

(52) U.S. Cl. ..... 112/225

(58) Field of Classification Search ..... 112/225, 112/302, 224, 99, 241
See application file for complete search history.

(56) References Cited

U.S. PATENT DOCUMENTS 4,185,574 A * 1/1980 Totino et al. ..... 112/225
4,651,660 A * 3/1987 Oshima et al. ..... 112/225
6,067,919 A * 5/2000 Shoji ..... 112/225
6,814,016 B2 * 11/2004 Hori ..... 112/225
6,918,344 B2 * 7/2005 Ebata et al. ..... 112/225
6,959,656 B2 * 11/2005 Fukao ..... 112/225
2004/0089210 A1 5/2004 Fukao
2004/0089211 A1 5/2004 Hori

FOREIGN PATENT DOCUMENTS

JP B2 2-14866 4/1990

* cited by examiner

*Primary Examiner*—Danny Worrell
(74) *Attorney, Agent, or Firm*—Oliff & Berridge, PLC

(57) ABSTRACT

A sewing machine includes a needle bar reciprocally movable up and down, a thread take-up lever reciprocally swingable up and down, a thread supply which supplies a needle thread to the needle bar carrying the sewing needle, a plurality of thread guides including the thread take-up lever, an automatic threading apparatus automatically carrying the needle thread extending from the thread supply and passing the needle thread through the thread guides including the thread take-up lever, a first preparatory path formed for threading so that the needle thread extending from the thread supply can be passed through the thread guides by the automatic threading apparatus, and a second preparatory path formed for threading so that the needle thread extending from the thread supply can manually be passed through the thread guides, The thread take-up lever is displaced within a range of reciprocal swing so that threading is possible for at least one of the first and second preparatory paths.

20 Claims, 28 Drawing Sheets

FIG. 9
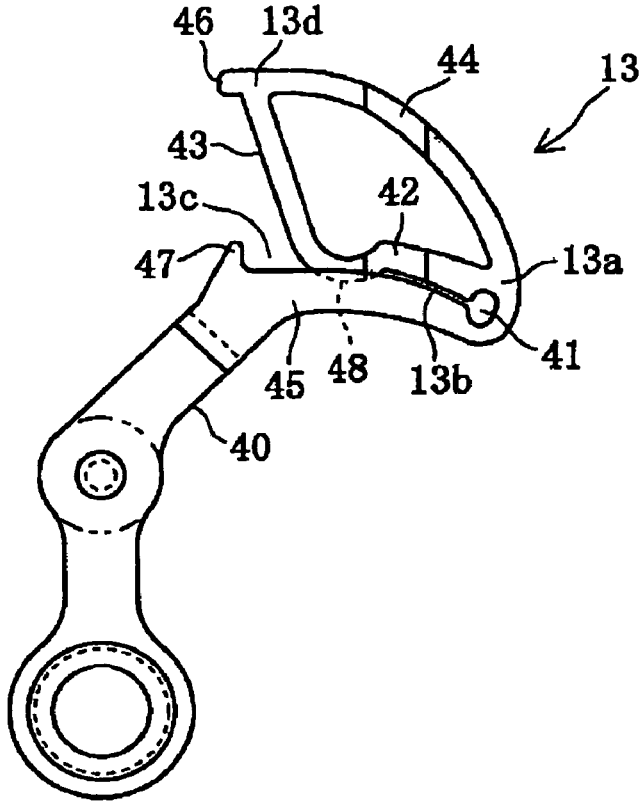
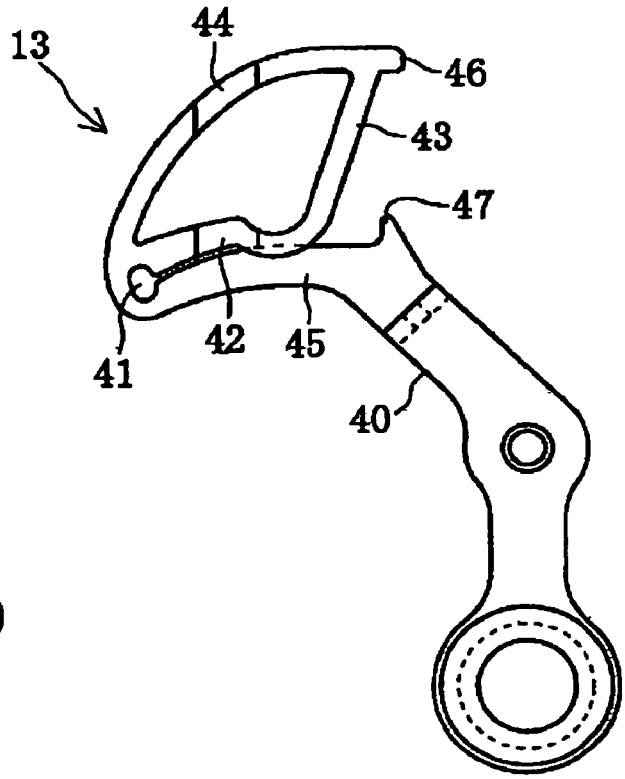
FIG. 10

SEWING MACHINE WITH AUTOMATIC THREADING APPARATUS

BACKGROUND OF THE INVENTION

1. Field of the Invention

This invention relates to a sewing machine provided with an automatic threading apparatus for automatically transferring a needle thread extending from a thread supply to thread a plurality of thread guides.

2. Description of the Related Art

In conventional sewing machines, a needle thread extending from a spool is threaded so as to be passed through a plurality of thread guides (a thread tension regulator, a take-up spring, a thread take-up lever and the like) in a predetermined sequence and via a predetermined path, so that the needle thread is led to a sewing needle mounted on a needle bar. The needle thread is then passed through an eye of the needle, whereupon the sewing machine is capable of sewing. The needle thread is manually passed through the thread guides in many sewing machines. However, a sewing machine provided with an automatic threading apparatus has been put into practical use. In use of the threading apparatus, a needle thread drawn from a spool is passed through a predetermined preparatory path. The threading apparatus automatically transfers the needle thread to thread a plurality of thread guides.

For example, JP-B-H02-14866 discloses an automatic threading apparatus includes a thread holding member, an operating lever having a distal end on which the thread holding member is pivotally mounted and a proximal end pivotally mounted on a machine frame, a thread carrying member having a distal end formed with an engagement portion and a proximal end pivotally mounted on a machine frame, and an operation unit. A thread tension regulator is provided at a position confronting an upper side of a sewing arm. When a needle thread is to be set so that sewing is executable, firstly, the needle thread extending from the spool is passed through the thread tension regulator, the thread guide of the take-up lever and the thread holding member in this sequence while a thread guide provided on a distal end of a thread take-up lever, the thread holding member and the engagement portion of the thread transferring member are caused to protrude to the upper side of the sewing arm for preparation.

When the operation unit is operated under the aforesaid condition, the operating lever and the thread transferring member pivot so that the thread holding member holding the needle thread is lowered near to the sewing needle. The needle thread is passed through the eye of the sewing needle by an automatic needle threader having a threading hook. Further, the needle thread is than caught by the engagement portion of the thread transferring member, and the thread transferring member is then lowered so that the needle thread is caught by a take-up spring disposed in the sewing arm. Threading needs to be manually carried out when the needle thread cannot automatically be passed through the thread guides for the reason of failure of the automatic threading apparatus or the like.

However, the above-noted reference discloses nothing about a technique of manually passing the needle thread through the thread guides. More specifically, in such a sewing machine as disclosed by the reference, the take-up spring, the thread take-up lever and thread tension discs are disposed in the interior of the sewing machine. Accordingly, it is difficult to manually pass the needle thread through a plurality of thread guides. It is supposed that manual threading is possible when front-side covers of the take-up spring, the thread take-up lever and thread tension discs cover are opened. However, the sewing machine with such an automatic threading apparatus as described in the above-noted reference is not constructed so as to be manually operated to pass the needle-thread through the thread guides. Accordingly, upon occurrence of failure in the automatic threading apparatus, it is difficult to pass the needle thread through the thread guides. For example, the needle thread cannot be passed through the thread guides easily and reliably until the threading apparatus is recovered from the failure, whereupon there is a possibility that this would cause troubles to sewing.

On the other hand, it is suggested that the front-side covers of the take-up spring, the thread take-up lever and thread tension discs cover be constructed to be normally openable so that manual threading becomes possible. However, the covers need to be opened when the manual threading is to be carried out, and the covers need to be closed after the manual threading has been carried out. Thus, a troublesome work is required. Further, even when the covers are closed, there is no guarantee that the needle thread can be passed through the thread guides readily and reliably. Furthermore, there is a possibility that foreign matter may fall into the interior of the sewing machine during opening of the covers, resulting in failure.

SUMMARY OF THE INVENTION

Therefore, an object of the present invention is to provide a sewing machine provided with an automatic threading apparatus, in which the needle thread can manually be passed through a plurality of thread guides readily and reliably, both of automatic threading and manual threading can be carried out by changing a position of the thread take-up lever without opening the sewing machine cover in the case of the manual threading, and the thread preparatory path for both automatic threading and manual threading and a thread introducing groove introducing the needle thread to the thread preparatory path can be simplified.

The present invention provides a sewing machine comprising a needle bar reciprocally movable up and down, the needle bar capable of carrying a sewing needle attached thereto, a thread take-up lever reciprocally swingable up and down, a thread supply which supplies a needle thread to the needle bar carrying the sewing needle, a plurality of thread guides including the thread take-up lever, an automatic threading apparatus automatically carrying the needle thread extending from the thread supply and passing the needle thread through the thread guides including the thread take-up lever, a first preparatory path provided for threading so that the needle thread extending from the thread supply can be passed through the thread guides by the automatic threading apparatus, and a second preparatory path provided for threading so that the needle thread extending from the thread supply can manually be passed through the thread guides, wherein the thread take-up lever is displaced within a range of reciprocal swing so that threading is possible for at least one of the first and second preparatory paths.

In the above-described construction, the first and second preparatory paths are provided, and the thread take-up lever is displaced within the range of reciprocal swing so that the needle thread can be passed along both first and second preparatory paths. Consequently, the needle thread passed along the first preparatory path for preparation can automatically be transferred and passed through a plurality of the thread guides by the automatic threading apparatus. Furthermore, when the needle thread is manually passed along the second preparatory path, the needle thread can be passed through a plurality of the thread guides. Thus, the needle thread can manually be passed through a plurality of the thread guides readily and reliably. Accordingly, for example, even if the automatic threading apparatus should fail, there is no possibility of trouble in execution of sewing. Moreover, since both automatic and manual threading operations are possible without change in the position of the thread take-up lever, the above-described operation can be achieved without complication of the sewing machine structure and increase in the production cost.

The invention also provides a sewing machine comprising a needle bar reciprocally movable up and down, the needle bar capable of carrying a sewing needle attached thereto, a thread take-up lever reciprocally swingable up and down, a thread supply which supplies a thread to the needle bar carrying the sewing needle, a plurality of thread guides including the thread take-up lever, an automatic threading apparatus automatically carrying the needle thread extending from the thread supply and passing the needle thread through the thread guides including the thread take-up lever, a first preparatory path provided for threading so that the needle thread extending from the thread supply can be passed through the thread guides by the automatic threading apparatus, a sewing machine cover, a first thread introducing groove formed in the sewing machine cover so as to be capable of introducing the needle thread to the first preparatory path, a second preparatory path provided for threading so that the needle thread extending from the thread supply can manually be passed through the thread guides, and a second thread introducing groove formed in the sewing machine cover so as to be capable of introducing the needle thread to the second preparatory path.

BRIEF DESCRIPTION OF THE DRAWINGS

Other objects, features and advantages of the present invention will become clear upon reviewing the following description of the embodiment with reference to the accompanying drawings, in which:

FIG. 9 is a left side view of the thread take-up lever;

FIG. 10 is a right side view of the thread take-up lever;

DETAILED DESCRIPTION OF THE INVENTION

Figure 1:
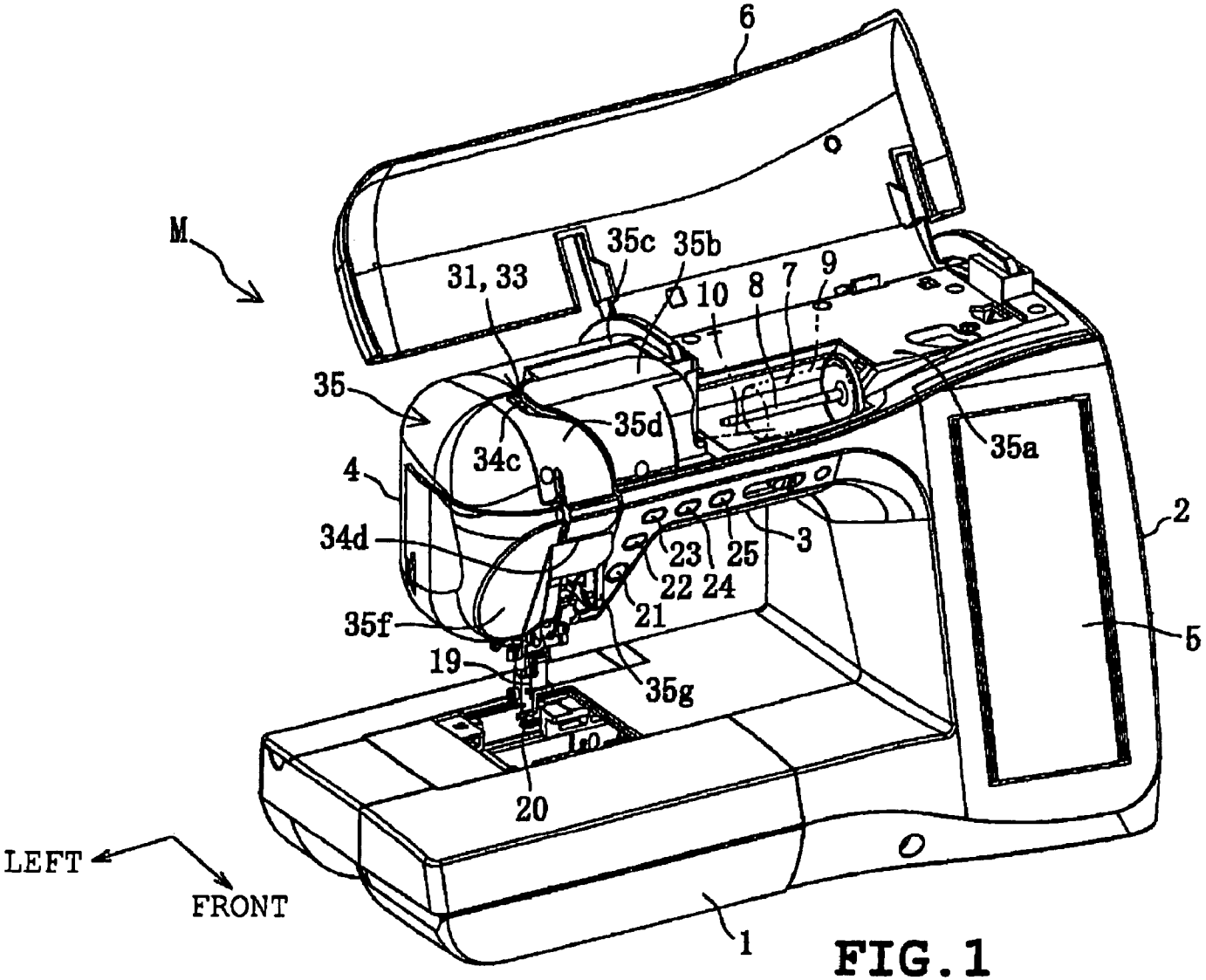
FIG. 1 is a perspective view of a sewing machine of one embodiment of the present invention as viewed at an obliquely upper position.
Figure 2:
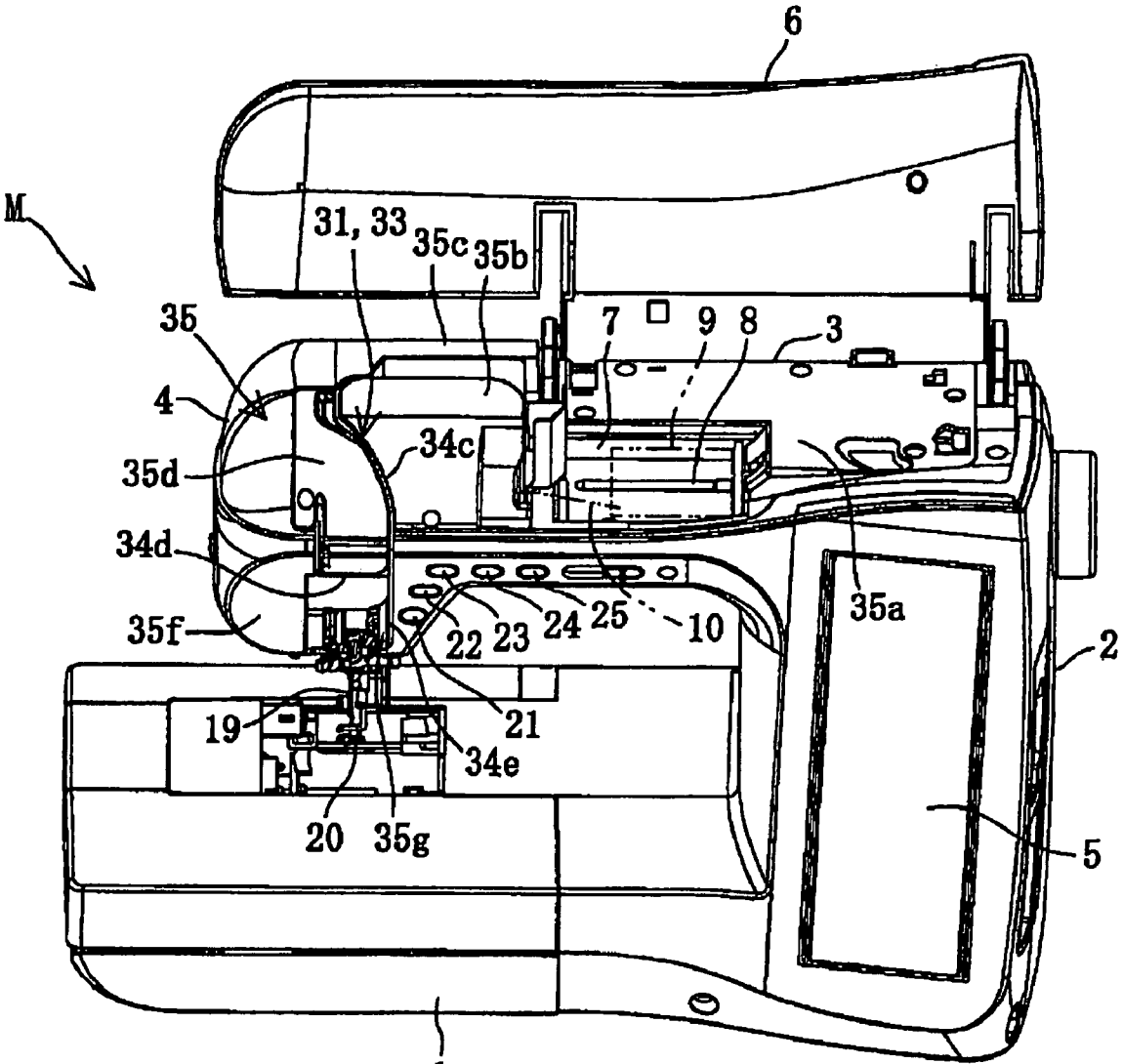
FIG. 2 is a perspective view of the sewing machine as viewed at an upper position.
Figure 3:
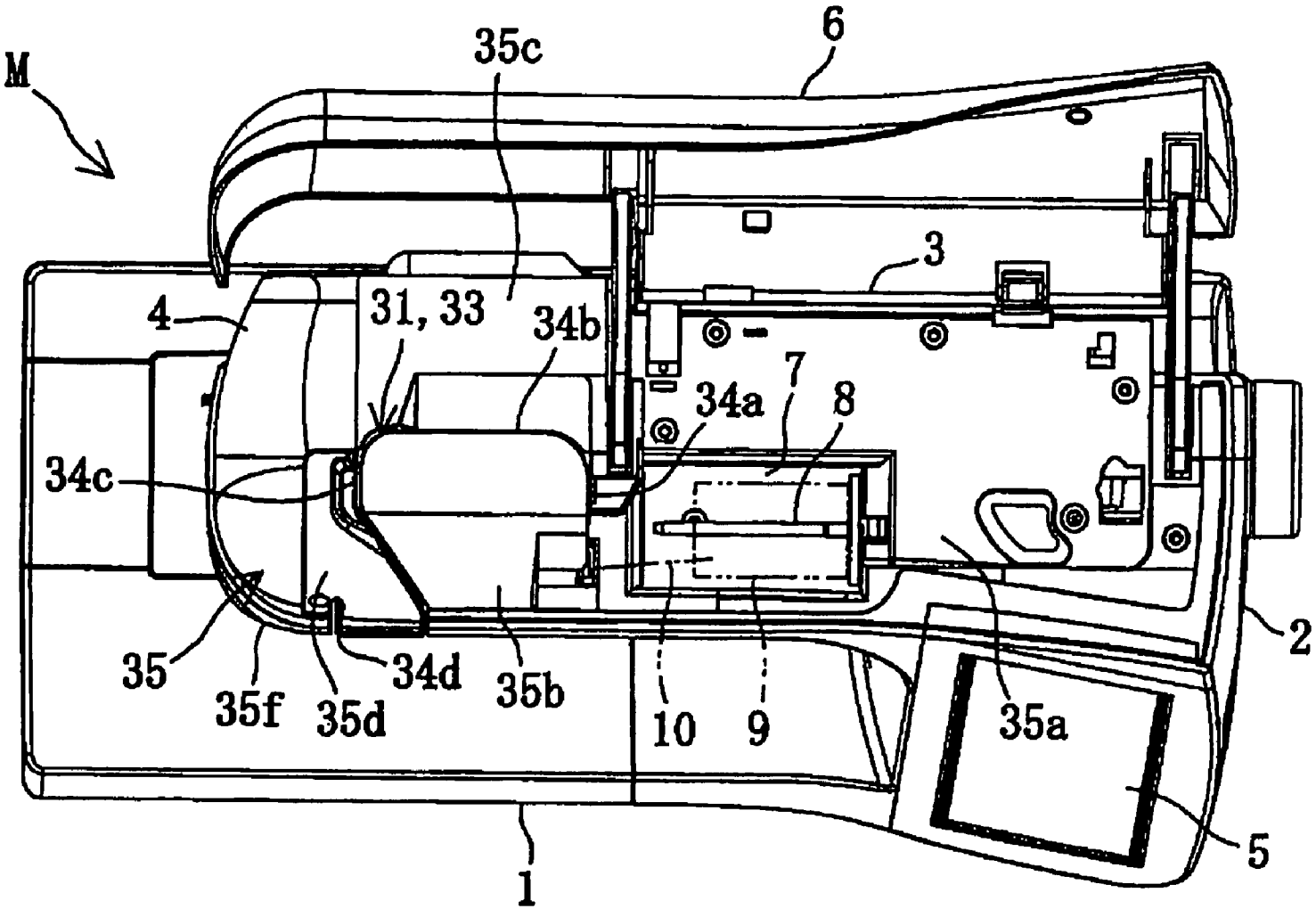
FIG. 3 is a plan view of the sewing machine.

One embodiment of the present invention will be described with reference to the accompanying drawings. Referring to FIGS. 1 to 3, a sewing machine M includes a sewing bed 1, a pillar 2 standing on a right part of the bed 1, a sewing arm 3 extending leftward from an upper part of the pillar 2 so as to be opposed to the bed 1 and a sewing head 4 mounted on a left part of the arm 3. The bed 1 includes a needle plate (not shown) and a shuttle mechanism (not shown) provided on the underside of the needle plate. A bobbin on which a bobbin thread is wound is detachably attached to the shuttle mechanism. A vertically long liquid-crystal display 5 is mounted on the front of the pillar 2.

An arm cover 6 is mounted on an upper rear end of the arm 3 so as to pivot about an axis extending right and left, thereby opening and closing an upper part of the arm 3. The cover 6 extends the whole length of the arm 3. A thread accommodating recess 7 is formed in the upper part of the arm 3 located on the right of the head 4. A spool pin 8 is provided in the recess 7. A spool 9 serving as a thread supply is attached to the spool pin B. The spool 9 is thus accommodated in the recess 7 so as to lie in the recess 7. A needle thread 10 extending from the spool 9 is passed through a plurality of thread guides such as a thread tension regulator 14, a take-up spring 15 and a thread take-up lever 13 to be supplied to a sewing needle 19 attached to the needle bar 11 (see FIGS. 13A and 14A).

Referring now to FIGS. 3 to 7, the head 4 is provided with the needle bar 11, a presser bar 12, the thread take-up lever 13, the thread tension regulator 14, the take-up spring 15, an automatic threading apparatus 16 and a needle threader 17. The needle bar 11 is mounted on a machine frame so as to be reciprocally movable up and down. The needle bar 11 has a lower end on which a needle-bar thread guide 18 is provided. Furthermore, the sewing needle 19 is attached to the lower end of the needle bar 11. The needle bar 11 is moved up and down by a sewing machine driving mechanism (not shown) including a sewing machine motor. The presser bar 12 is disposed in the rear of the needle bar 11 and supported on the sewing machine frame so as to be moved up and down. The presser bar 12 has a lower end to which a presser foot 20 (see FIGS. 1 and 2) is attached. On the lower front of the arm 3 are provided a sewing start switch 21, a sewing finish switch 22, an automatic threading preparatory switch 23, a manual threading preparatory switch 24, as shown in FIGS. 1 and 2.

Referring to FIGS. 4 to 7 and 13A, the thread take-up lever 13 is mounted on the upper front of the needle bar 11. The thread take-up lever 13 has a proximal end mounted on the sewing machine frame so as to pivot about an axis extending right and left. The thread take-up lever 13 is swung up and down by the sewing machine driving mechanism in synchronization with the needle bar 11. The thread tension regulator 14 has a pair of thread tension discs 14*a* and 14*b* and is disposed at the spool 9 side which is the right side with respect to the thread take-up lever 13 (upstream relative to the thread take-up lever 13). The paired thread tension discs 14*a* and 14*b* are mounted via a thread tension shaft 14*c* extending right and left on an upper end of a first guide frame 52 of the automatic threading apparatus 16. The take-up spring 15 is located below the thread tension regulator 14 (upstream relative to the thread take-up lever 13 and downstream relative to the thread tension regulator 14). The take-up spring 15 is mounted on a lower end of the first guide frame 52.

The sewing machine M is provided with a first preparatory path 30, a first introduction groove 31, a second preparatory path 32, a second introduction groove 33 as shown in FIGS. 1 to 8, 13A and 14A. The first threading path 30 is provided for preparing the needle thread 10 extending from the spool 9 attached to the spool bar 8 so that the needle thread 10 can be passed through a plurality of thread guides (the thread tension regulator 14, the take-up spring 15, thread take-up lever 13 and the like) by the automatic threading apparatus 16 and further through an eye of the needle 19 by the needle threader 17. The first introduction groove 31 is formed in a sewing machine cover 35 so as to be capable of introducing the needle thread 10 to the first threading path 30. The second preparatory path 32 is provided for manually passing the needle thread 10 extending from the spool 9 attached to the spool bar 8, through a plurality of thread guides. The second introduction groove 33 is formed in the sewing machine cover 35 so as to be capable of introducing the needle thread 10 to the second preparatory path 32.

The first and second introduction grooves 31 and 33 will now be described. Referring to FIGS. 1 to 3 and 8, on the upper portion of the arm 3 are provided an upper cover 35*a*, a thread-introducing front cover 35*b*, a rear cover 35*c* and a thread guide cover 35*d* all of which constitute parts of the sewing machine cover 35 respectively. The front cover 35*e* occupies a large part of the lower front of the arm 3. A face plate 35*f* occupies a large part of the head 4. A thread-introducing cover 35*g* is provided at a right end side of the lower front of the face plate 35*f*. The thread accommodating recess 7 is formed in the upper cover 35*a*.

The upper cover 35*a* has a left end located on the lengthwise center of the arm 3. An introducing groove 34*a* is formed in between the upper cover 35*a* and the thread-introducing front cover 35*b* located on the left of the upper cover 35*a*. An introducing groove 34*b* is formed in between the thread-introducing front cover 35*b* and the rear cover 35*c* located on the rear of the thread-introducing front cover 35*b*. A curved introducing groove 34*c* is formed in between a thread guide cover 35*d*, and the thread-introducing front cover 35*b* located on the right of the cover 35*b* and a front cover 35*e*. Further, an L-shaped introducing groove 34*d* is formed in between the thread guide cover 35*d* and a face plate 35*f* located under and at a lower left side of the guide cover 35*d*. An introducing groove 34*f* is formed in between the thread-introducing cover 35*g* and a face plate 35*f* located in front of the thread-introducing cover 35*g*. An introducing groove 34*g* is formed in between the thread-introducing cover 35*g* and the thread guide cover 35*d* located in front of the thread-introducing cover 35*g*.

In this case, the introducing grooves 34*a*, 34*b* and 34*c* are serially connected to one another. To the introducing cover 34*c* are connected the introducing grooves 34*d* and 34*f* which are bifurcated from the lower end of the introducing cover 34. The introducing grooves 34*a*, 34*b*, 34*c*, and 34*d* constitute a first thread-introducing groove 31. The introducing grooves 34*a*, 34*b*, 34*c*, 34*e*, 34*f* and 34*g* constitute a second thread-introducing groove 33. In other words, a part (the introducing grooves 34*a*, 34*b* and 34*c*) of the first thread-introducing groove 31 is common to a part (the introducing grooves 34*a*, 34*b* and 34*c*) of the second thread-introducing groove 33.

The thread take-up lever 13 will now be described in detail. Referring to FIGS. 4, 5 and 9 to 12, the thread take-up lever 13 is formed substantially into an L-shape as viewed in a side view and into the shape of a crank as viewed in a front view. The thread take-up lever 13 is swung up and down by the sewing machine driving mechanism (not shown). The thread take-up lever 13 includes a lever threading portion 41 through which the needle thread 10 is passed so that sewing can be carried out, a lever thread introducing portion 42 introducing the needle thread 10 to the lever threading portion 41, an introduction guide portion 43 guiding the needle thread 10 to the lever thread introducing portion 42 and an escape guide portion 44 capable of guiding the needle thread 10 outside the thread take-up lever 13 so that the needle thread 10 is manually passed through one of the thread tension regulator 14 and the take-up spring 15 upstream relative to the thread take-up lever 13.

The lever threading portion 41 is a small elliptic hole formed in a lever distal end 13*a* and communicates with a thread introducing groove 13*b* comprised of a space defined by a thread receiving portion 45 extending from a thread take-up lever body 40 to a distal end 13*a* of the thread take-up lever 13 and a lever introducing portion 42. The needle thread 10 is introduced through the thread introducing groove 13*b* to the lever threading portion 41. An introducing guide portion 43 includes a linear portion having approximately the same length as a distance from a thread introducing opening 13*c* which is an open end of the thread introducing groove 13*b* to the lever introducing portion 42. The linear portion meets the thread receiving portion 45 at about 120 degrees. An escape guide 44 is formed to extend from the lever distal end 13*a* to an end 13*d* of the introducing guide portion 43. The escape guide 44 is formed into an arc shape and has a central portion expanding outward.

The end 13*d* of the introducing guide portion 43 is formed with a first thread engagement portion 46 which engages the needle thread 10 so that the needle thread 10 passed through the introducing guide portion 43 is prevented from falling off to the side opposite the thread receiving portion 45. The thread receiving portion 45 has a proximal end formed with a second thread engagement portion 47 which engages the needle thread 10 so that the needle thread 10 received by the thread receiving portion 45 is prevented from falling off to the side opposite the lever introducing portion 42. A junction of the lever introducing portion 42 and the introducing guide portion 43 is formed into a protrusion 48 protruding toward the thread receiving portion 45. The protrusion 48 overlaps the thread receiving portion 45. The protrusion 48 prevents the needle thread 10 introduced to the lever threading portion 41 from falling off through a gap between the thread receiving portion 45 and the lever introducing portion 42.

Figure 4:
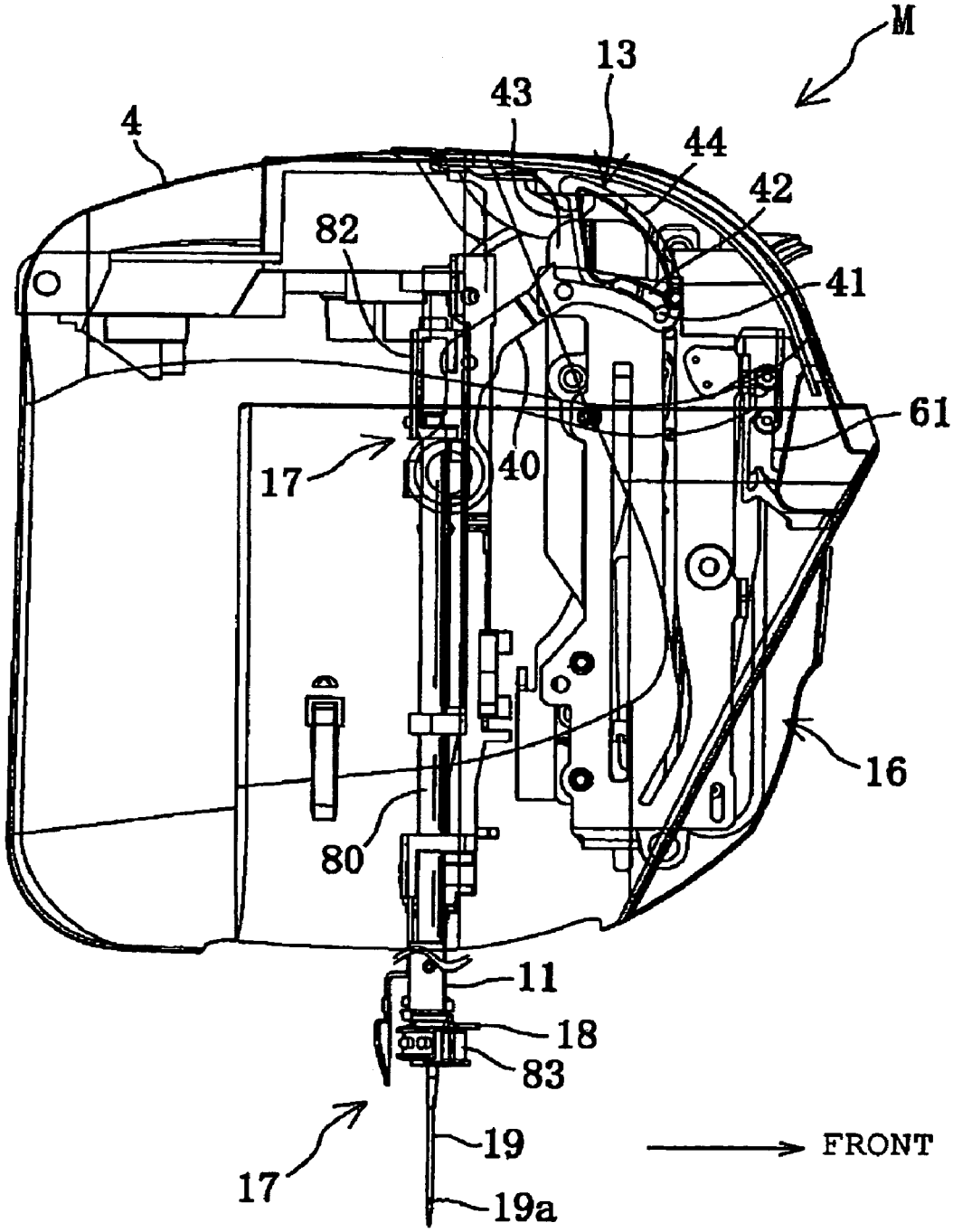
FIG. 4 is a perspective left side view of the sewing machine in an automatically threading condition.
Figure 5:
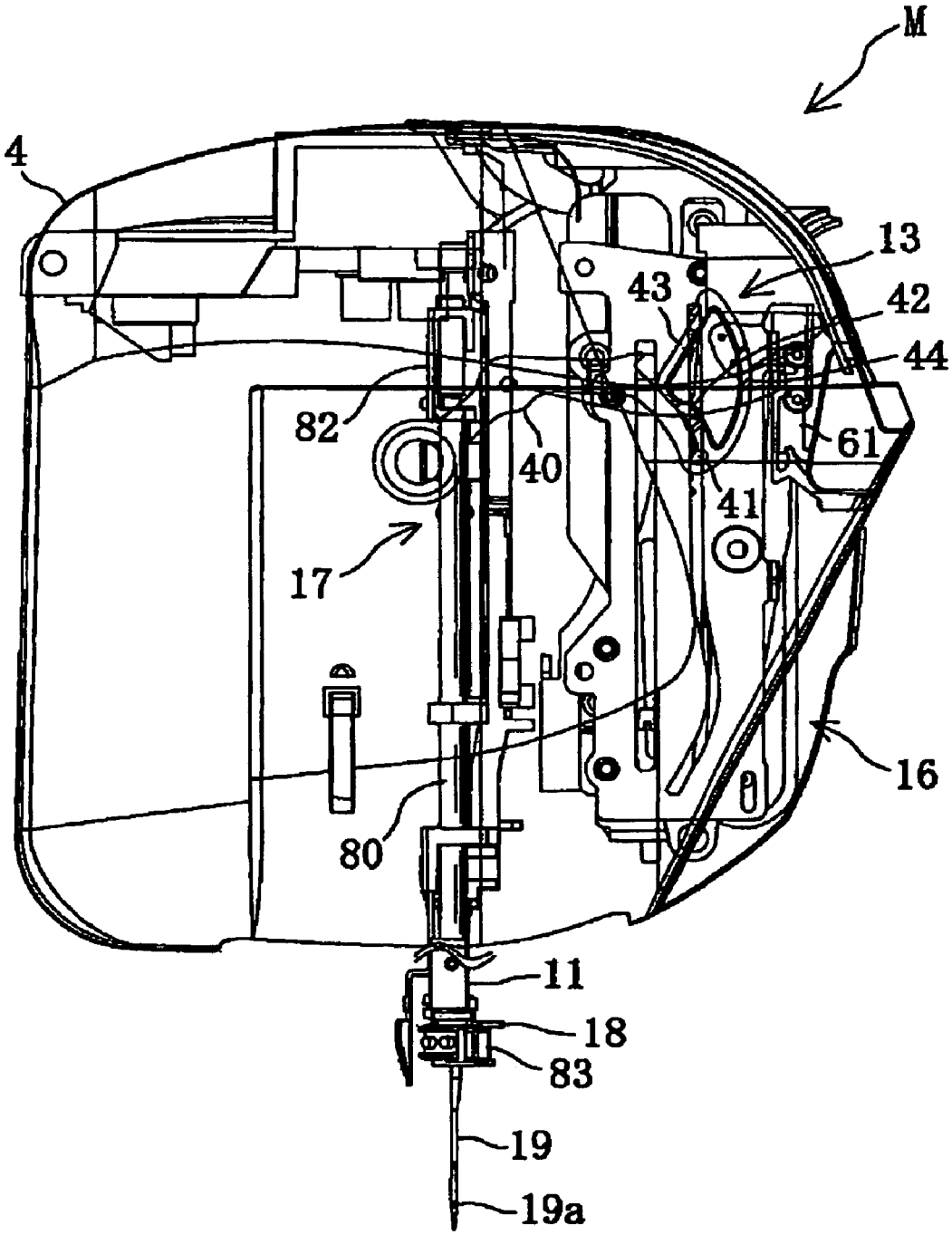
FIG. 5 is a perspective left side view of the sewing machine in a manually threading condition.
Figure 6:
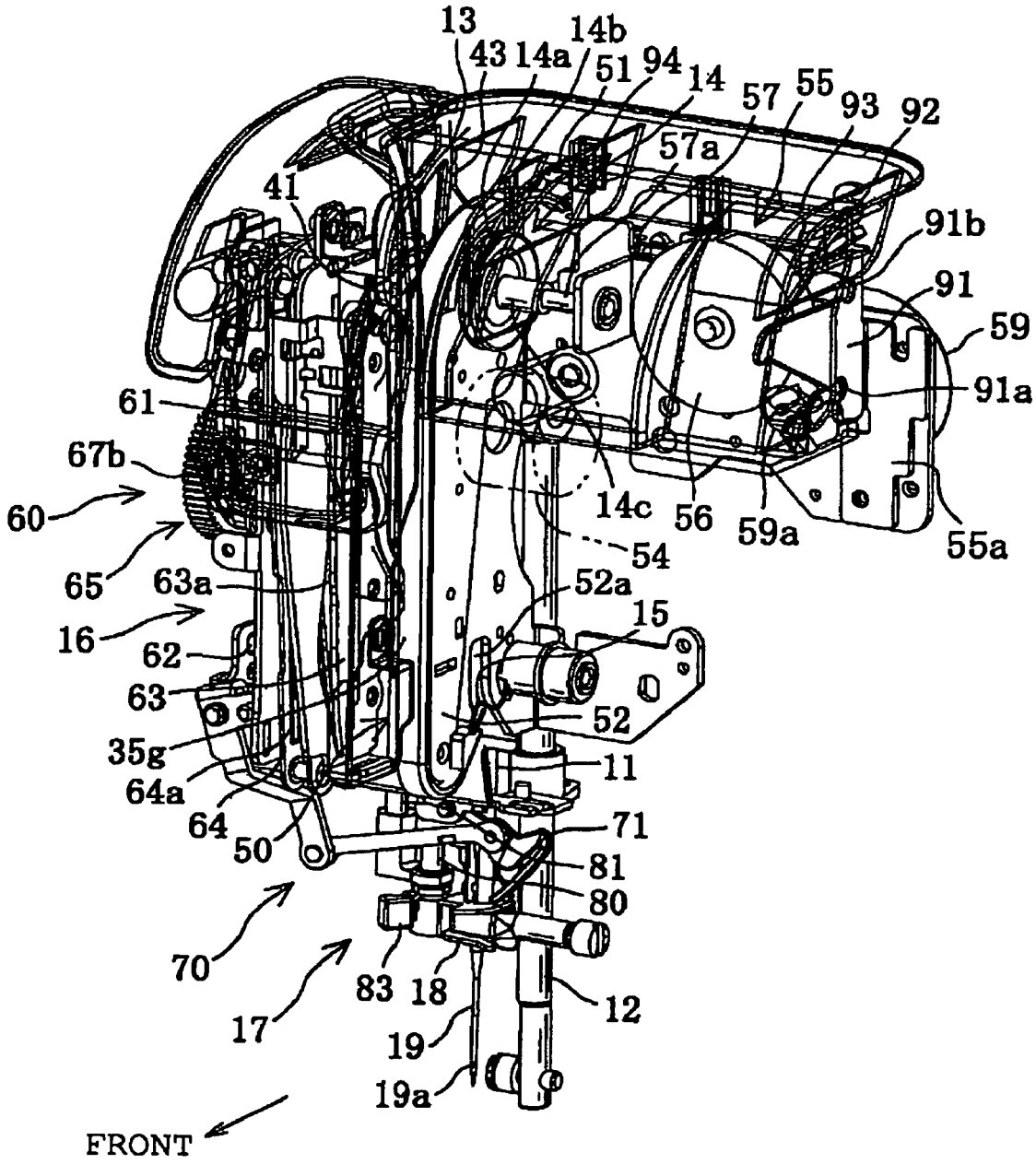
FIG. 6 is a perspective view of the automatic threading apparatus and automatic needle threader as viewed at an obliquely right upper position.
Figure 7:
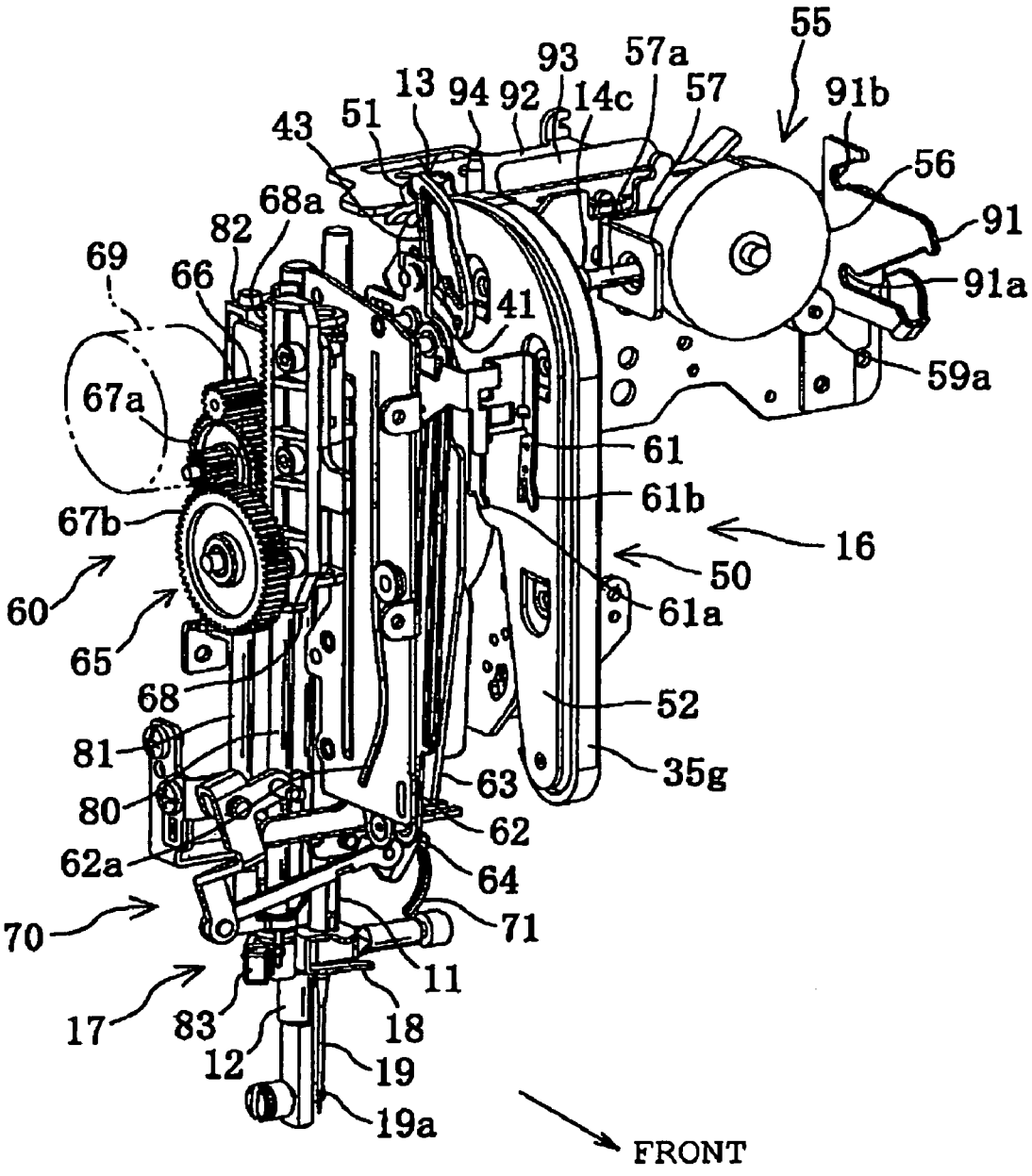
FIG. 7 is a perspective view of the automatic threading apparatus and automatic needle threader as viewed at an obliquely left upper position.
Figure 8:
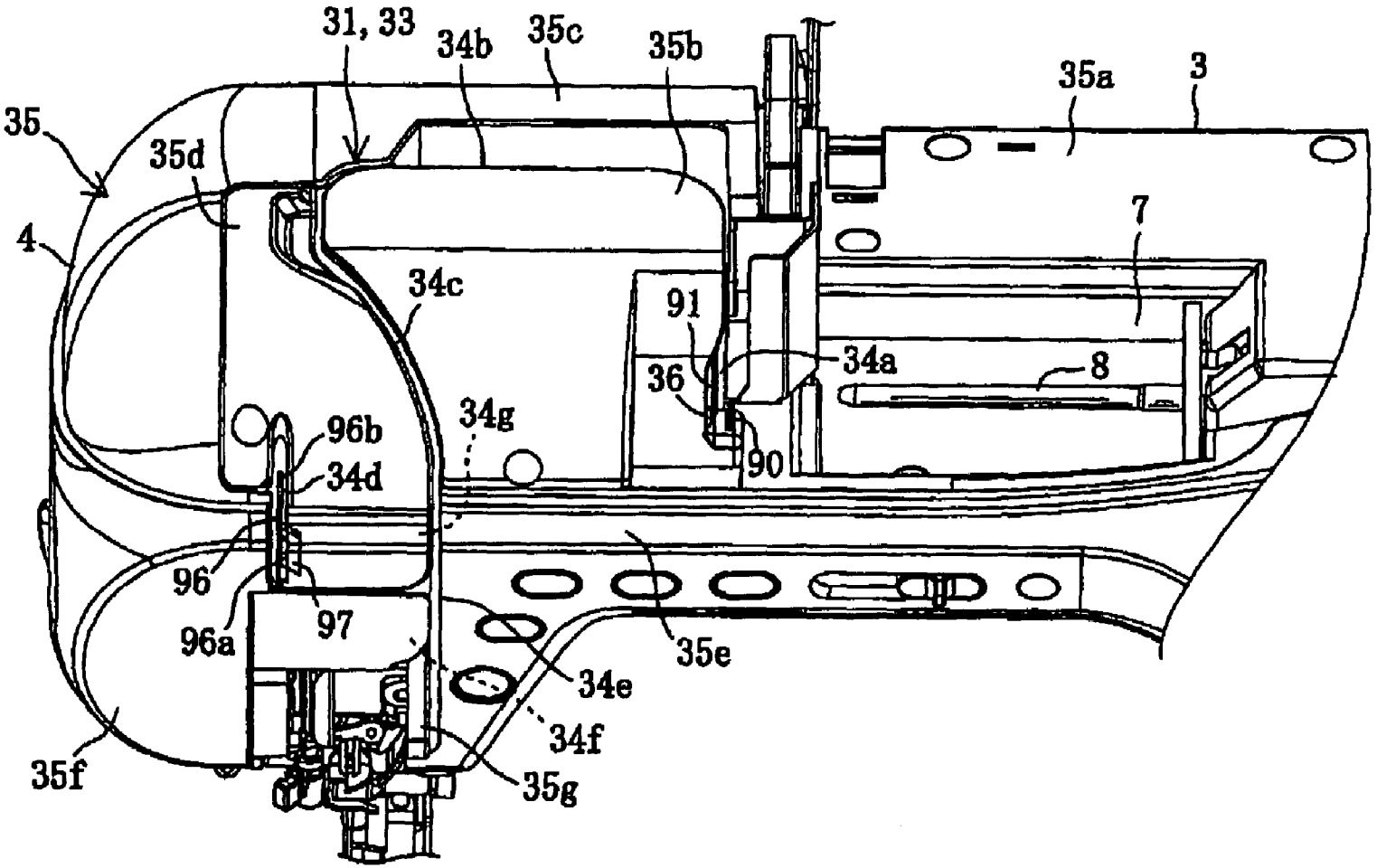
FIG. 8 is a partially enlarged view of the sewing machine as shown in FIG. 2.
Figure 11:
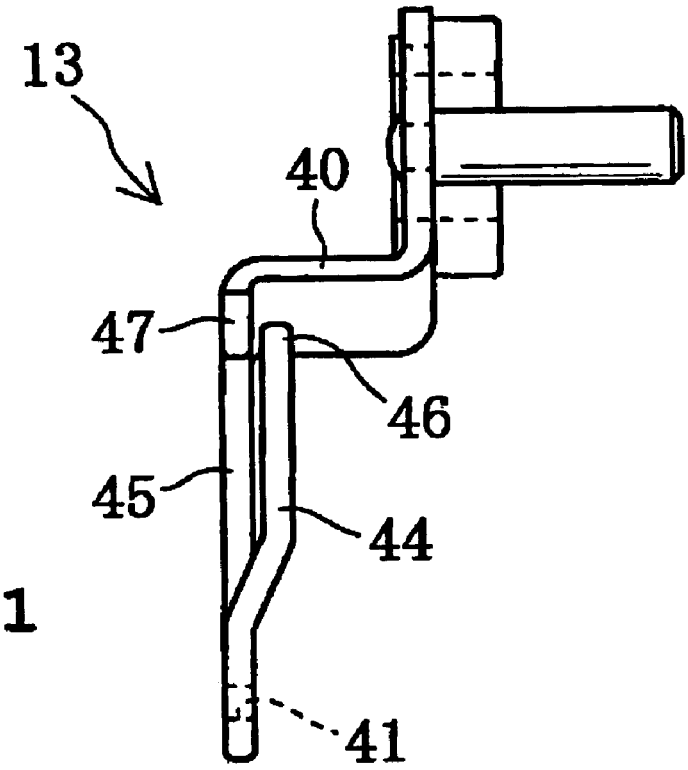
FIG. 11 is a plan view of the thread take-up lever.
Figure 12:
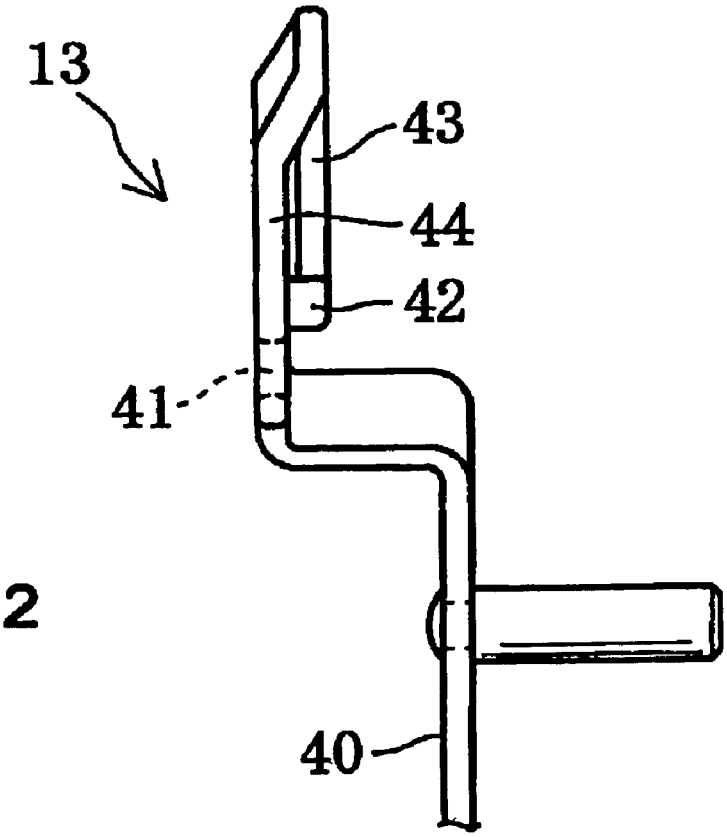
FIG. 12 is a front view of the thread take-up lever.

In the sewing machine M, as shown in FIG. 4, the needle thread 10 is capable of being passed through the first preparatory path 30 when the thread take-up lever 13 has been switched to a first position near a rise limit position. Furthermore, the needle thread 10 is capable of being passed through the second preparatory path 32 when the thread take-up lever 13 has been switched to a second position lower than the first position, as shown in FIG. 5. A main shaft of the sewing machine driving mechanism is rotated 35 degrees, for example, when the thread take-up lever 13 is moved from the first position to the second position. When the automatic threading preparatory switch 23 is turned on, the thread take-up lever 13 not located at the first position can automatically be moved to the first position and stopped. Further, when the manual threading preparatory switch 24 is turned on, the thread take-up lever 13 not located at the second position can automatically be moved to the second position and stopped.

As shown in FIG. 4, when the thread take-up lever 13 has been switched to the first position, the escape guide 44 is directed obliquely upward toward the front and the thread take-up lever 13 is inclined at an inclination of about 80 degrees with the horizontal direction so that the introducing guide portion 43 is transferred forward as it goes downward. In this state, the lever introducing portion 42 of the thread take-up lever 13 is inclined at an inclination of about 20 degrees with the horizontal direction so as to be transferred downward as it goes forward. The needle thread 10 on the first thread preparatory path 30 is allowed to pass through the introducing guide portion 43 from behind. Furthermore, as shown in FIG. 5, when the thread take-up lever 13 has been switched to the second position, the escape guide 44 is directed frontward and the introducing guide portion 43 is inclined at an inclination of about 60 degrees with the horizontal direction so that the introducing guide portion 43 is transferred rearward as it goes downward. In this state, the lever introducing portion 42 is inclined at an inclination of about 60 degrees with the horizontal direction so as to be transferred downward as it goes forward.

The automatic threading apparatus 16 will now be described. As shown in FIGS. 6, 7, 13A to 13F, 14A to 14F and 15A to 15F, the automatic threading apparatus 16 includes a first thread transferring mechanism 50 having a first thread transferring member 51, a first pulse motor 54 (corresponding to a first driver) driving the first thread transferring mechanism 50, a second thread transferring mechanism 60 having a second thread transferring member 61 and a second pulse motor 69 (corresponding to a second driver) driving the second thread transferring mechanism 60. The first transferring member 51 transfers the needle thread 10 set on the first thread preparatory path to pass the needle thread 10 through a plurality of thread guides including the thread take-up lever 13 (the thread tension regulator 14, the take-up spring 15, the thread take-up lever 13 and the like). The second transferring member 61 transfers the needle thread 10 located downstream relative to the thread take-up lever 13, to the sewing needle 19.

In the first thread transferring mechanism 50, the first thread transferring member 51 catches the needle thread 10 located upstream relative to the introducing guide portion 43 to transfer the needle thread 10 toward the take-up spring 15. During transfer, the needle thread 10 is passed through the thread tension regulator 14, and the needle thread 10 having been transferred is passed through the take-up spring 15. The first and second thread transferring members 51 and 61 pass the needle thread 10 through the lever threading portion 41 of the thread take-up lever 13 during transfer of the needle thread 10.

Figure 13A:
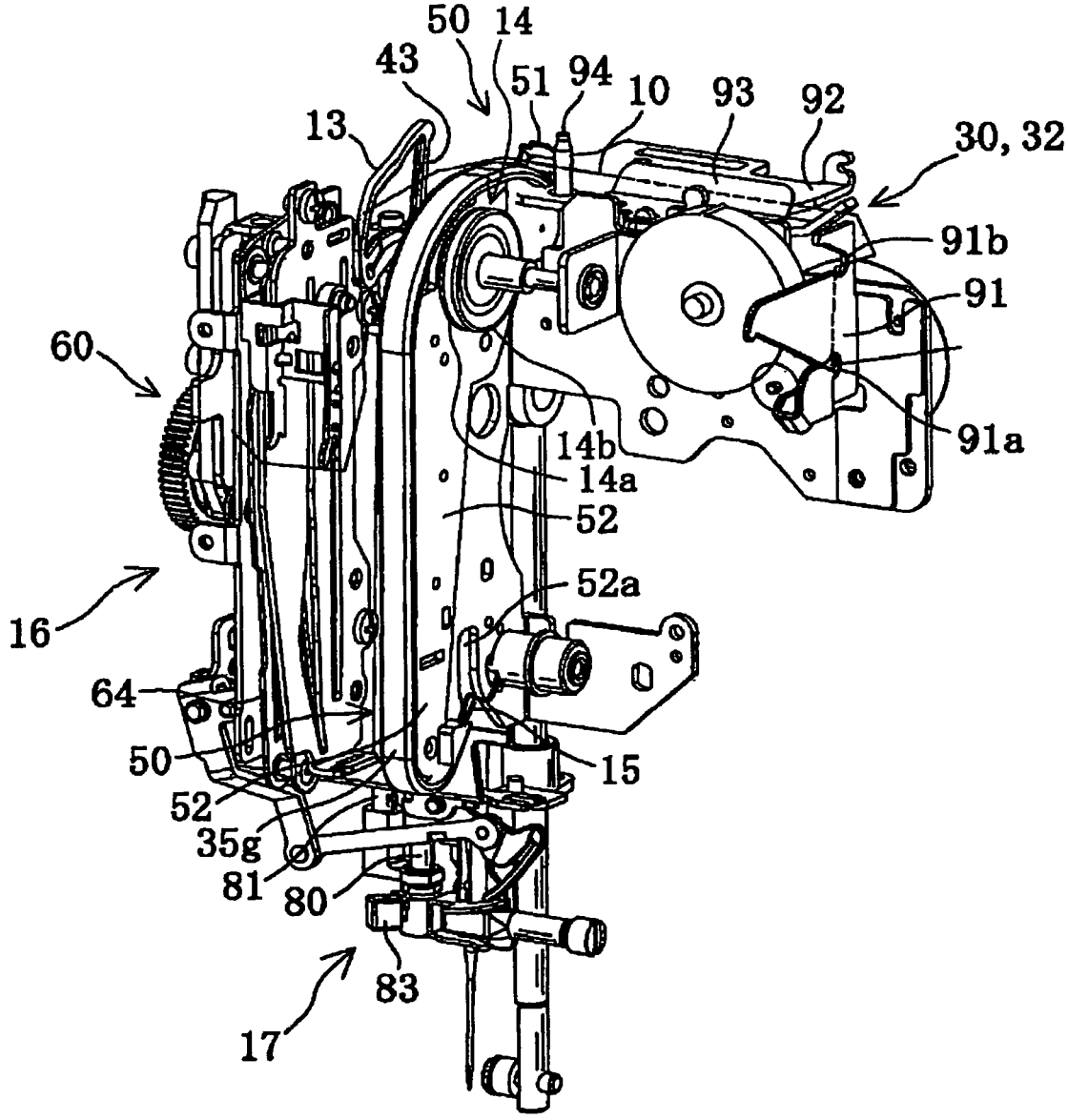
FIG. 13A is a perspective view of the automatic threading apparatus and automatic needle threader in a standby state.
Figure 13B:
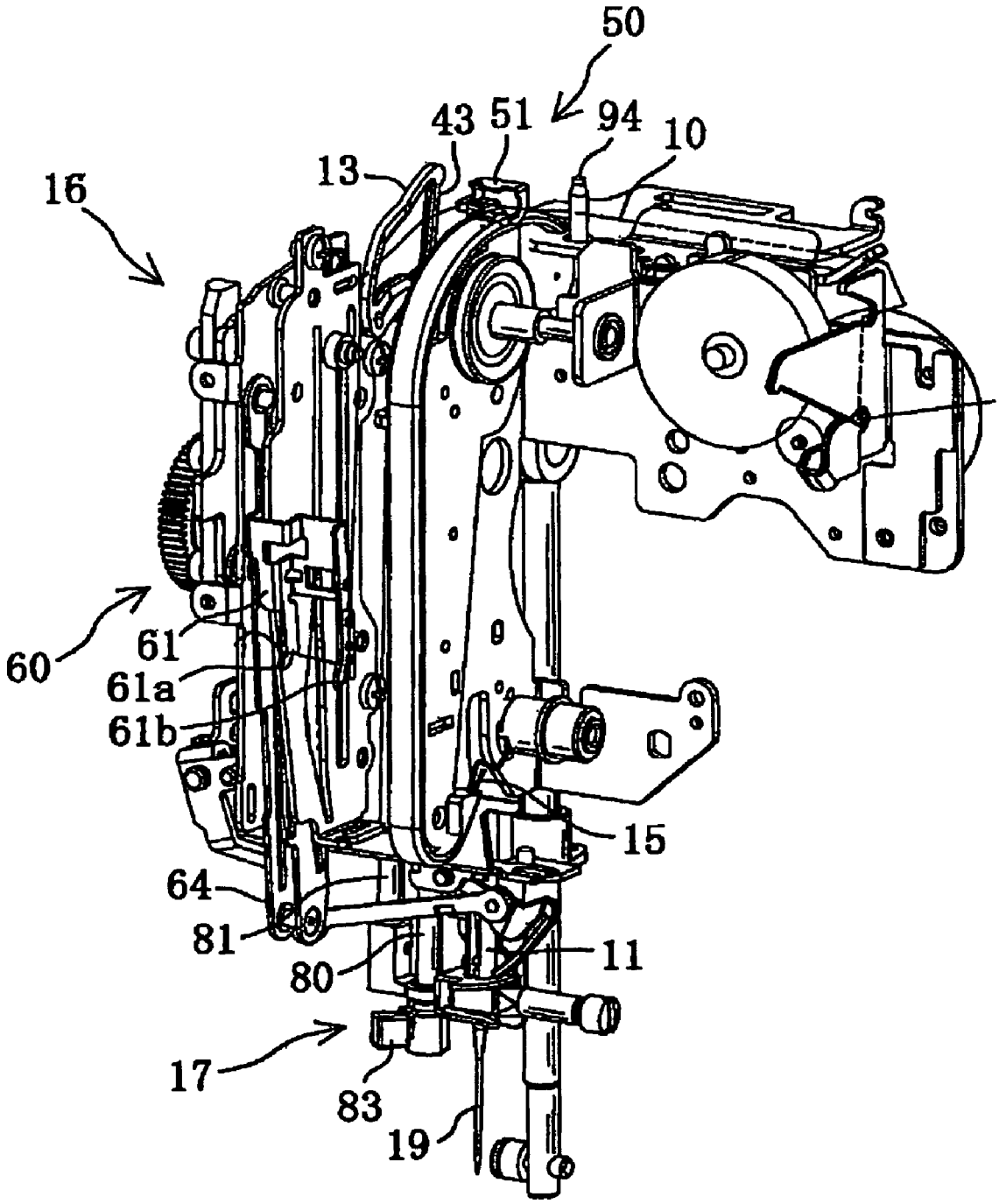
FIG. 13B is a perspective view of the automatic threading apparatus and automatic needle threader in a threading state.
Figure 13C:
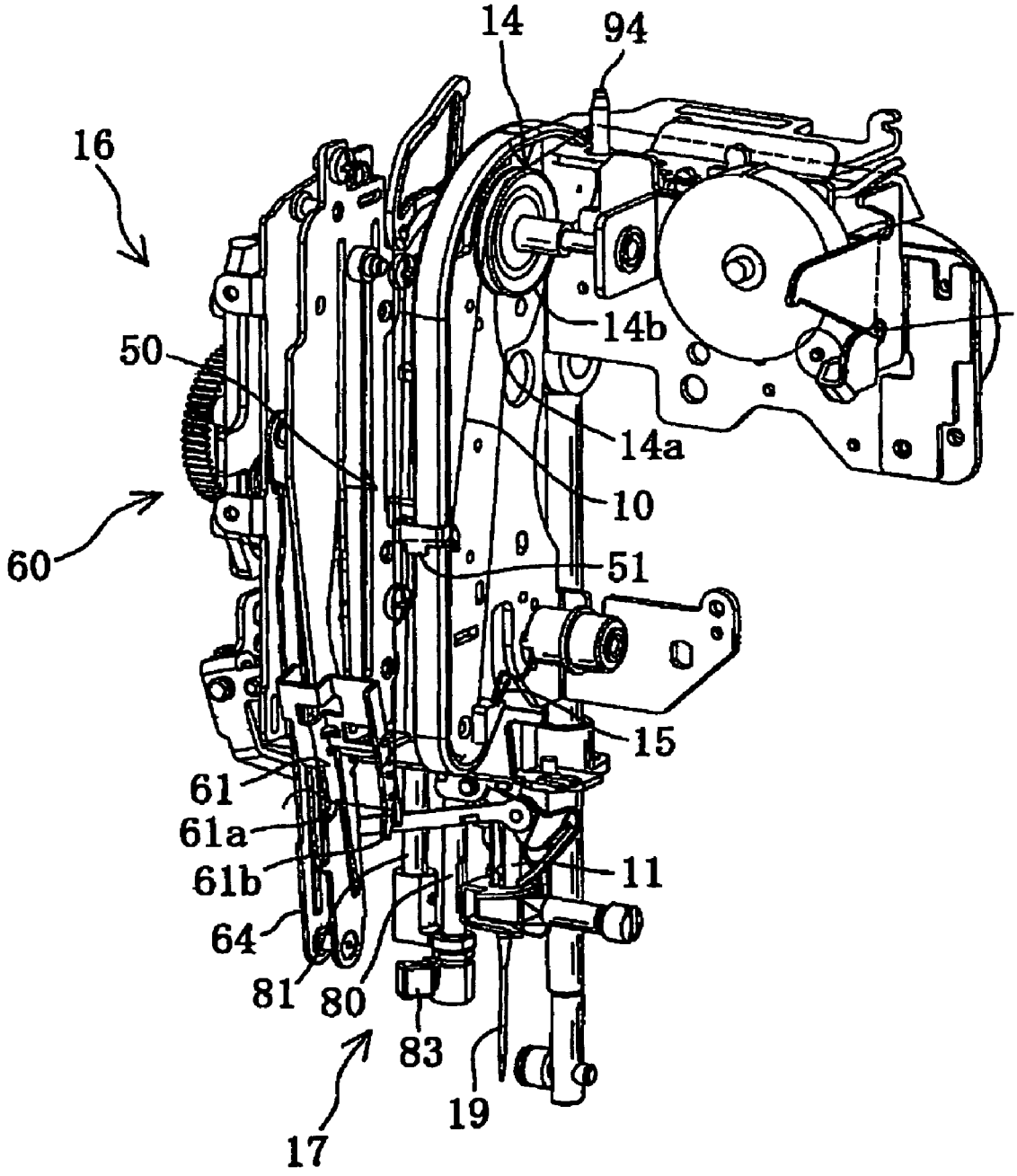
FIG. 13C is a perspective view of the automatic threading apparatus and automatic needle threader in a case where the thread take-up lever is threaded.
Figure 13D:
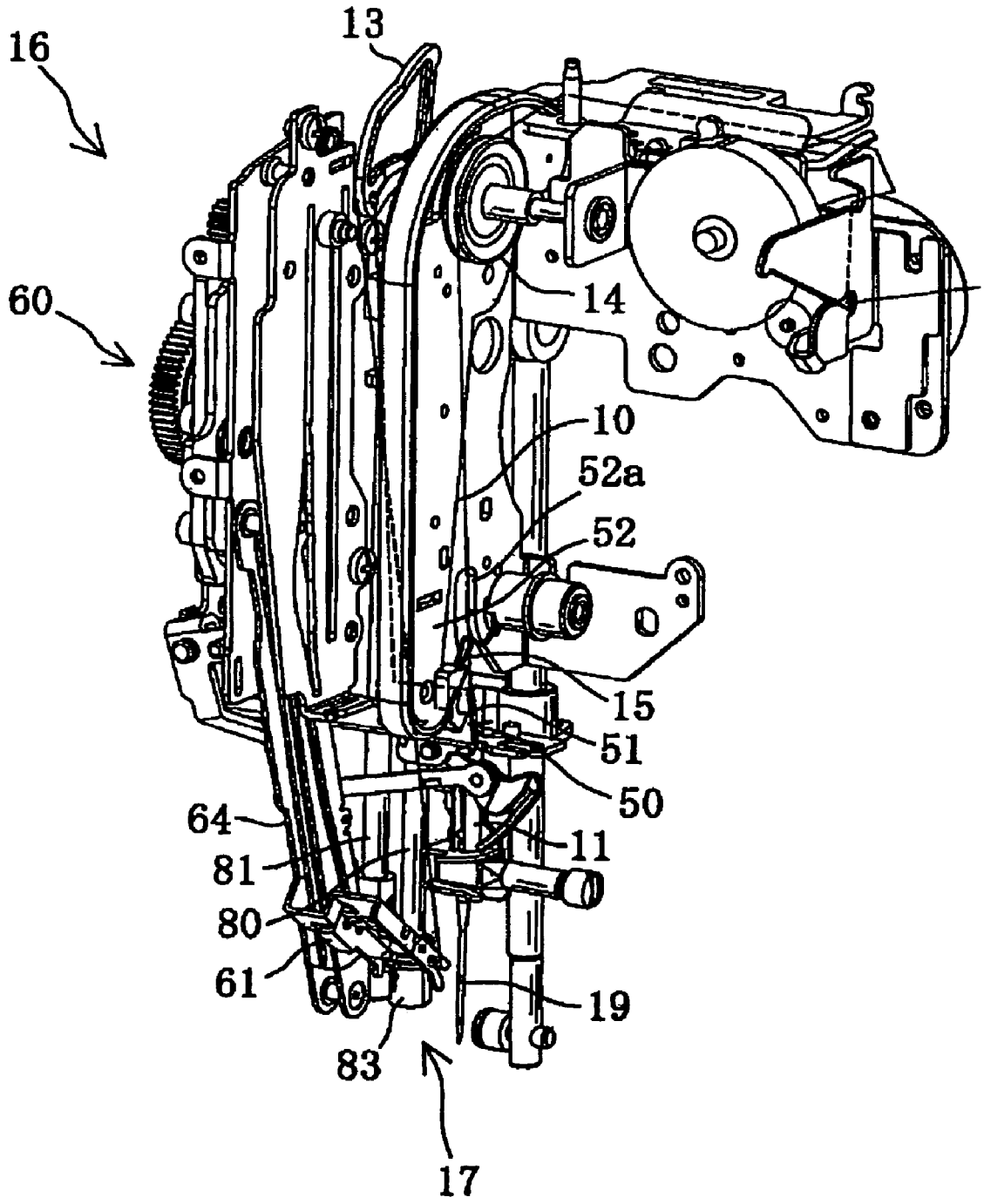
FIG. 13D is a perspective view of the automatic threading apparatus and automatic needle threader in a case where a take-up spring is threaded.
Figure 14A:
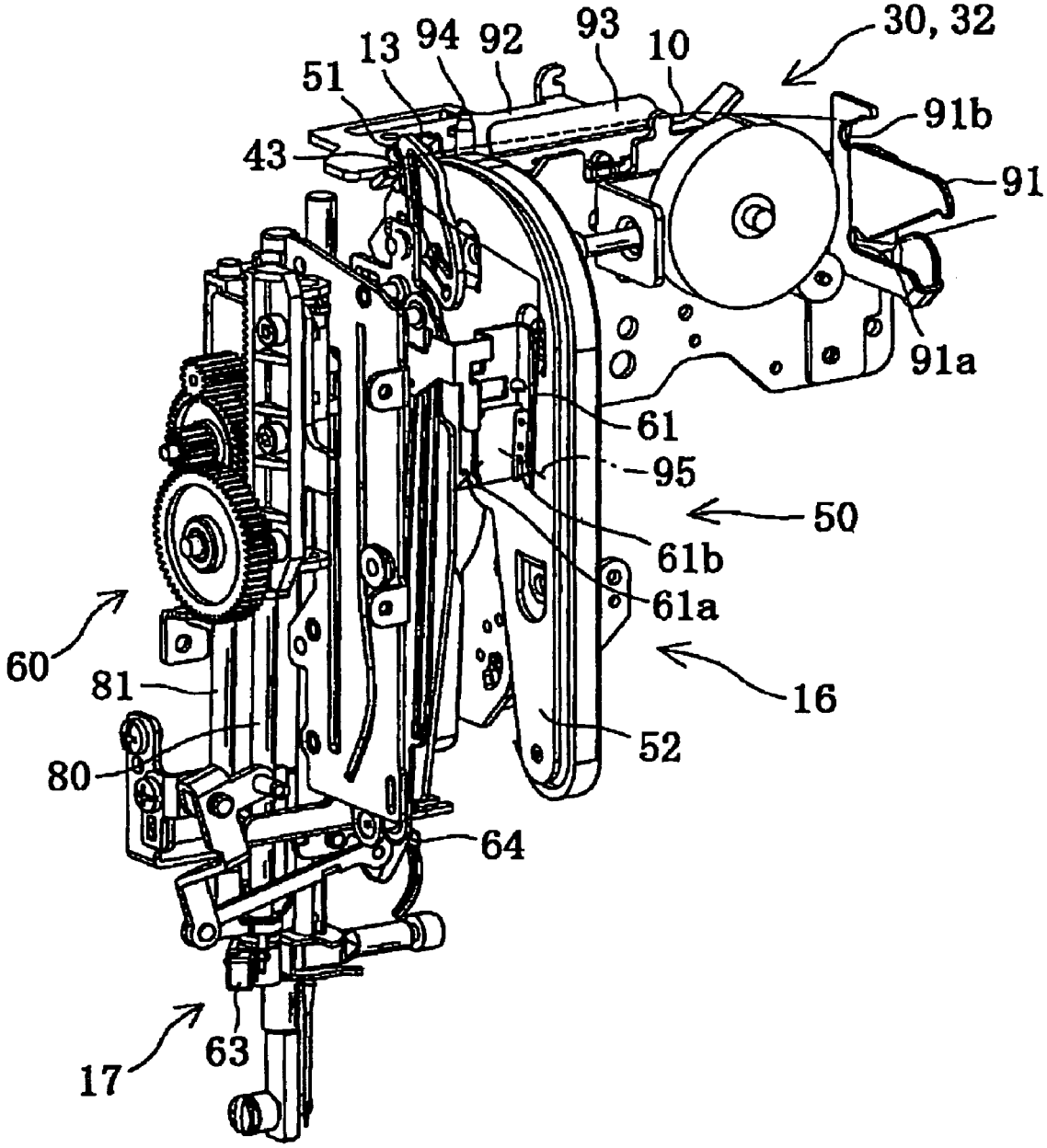
FIG. 14A is a perspective view of the automatic threading apparatus and automatic needle threader in a standby state.
Figure 14B:
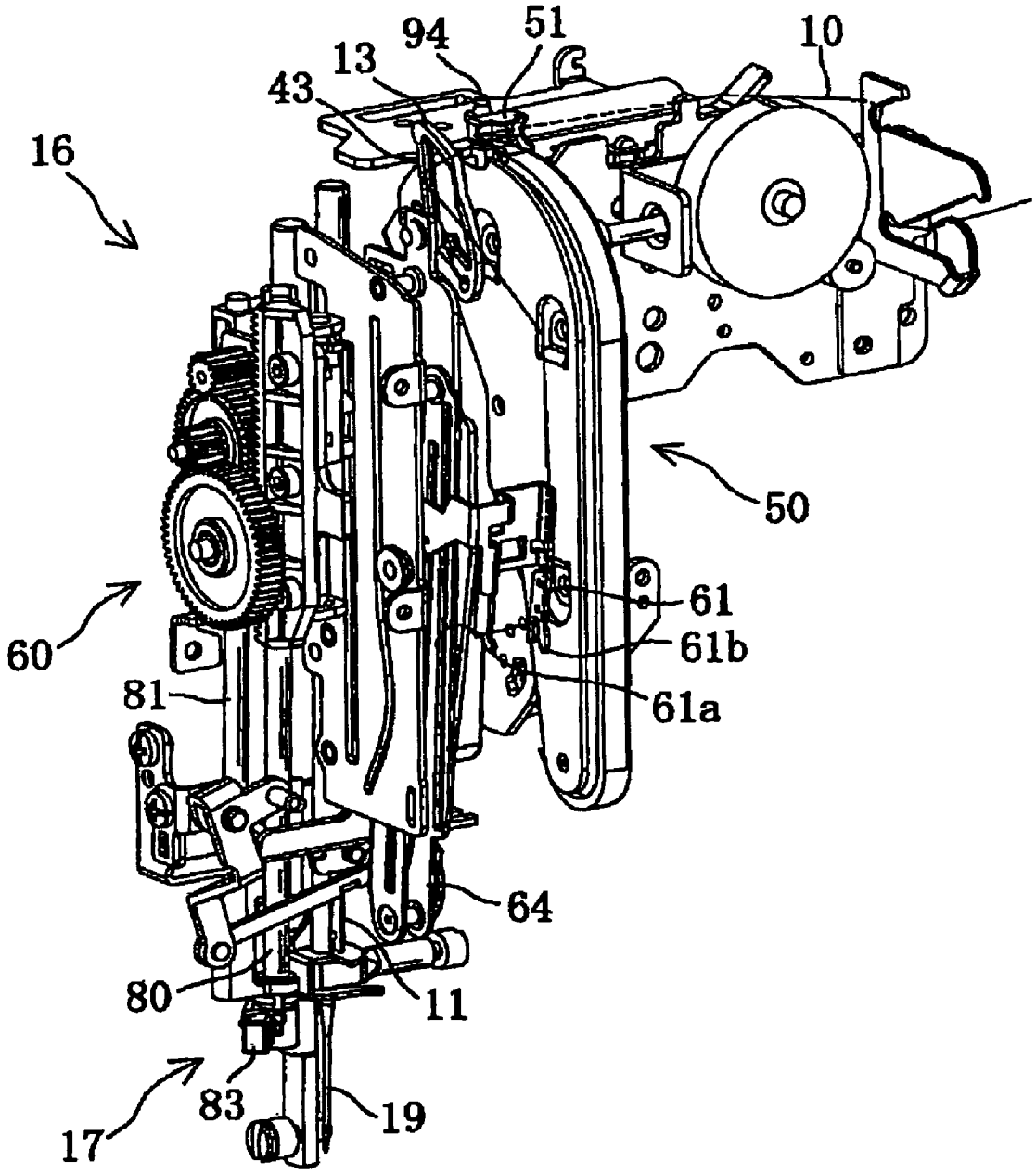
FIG. 14B is a perspective view of the automatic threading apparatus and automatic needle threader in a threading state.
Figure 14C:
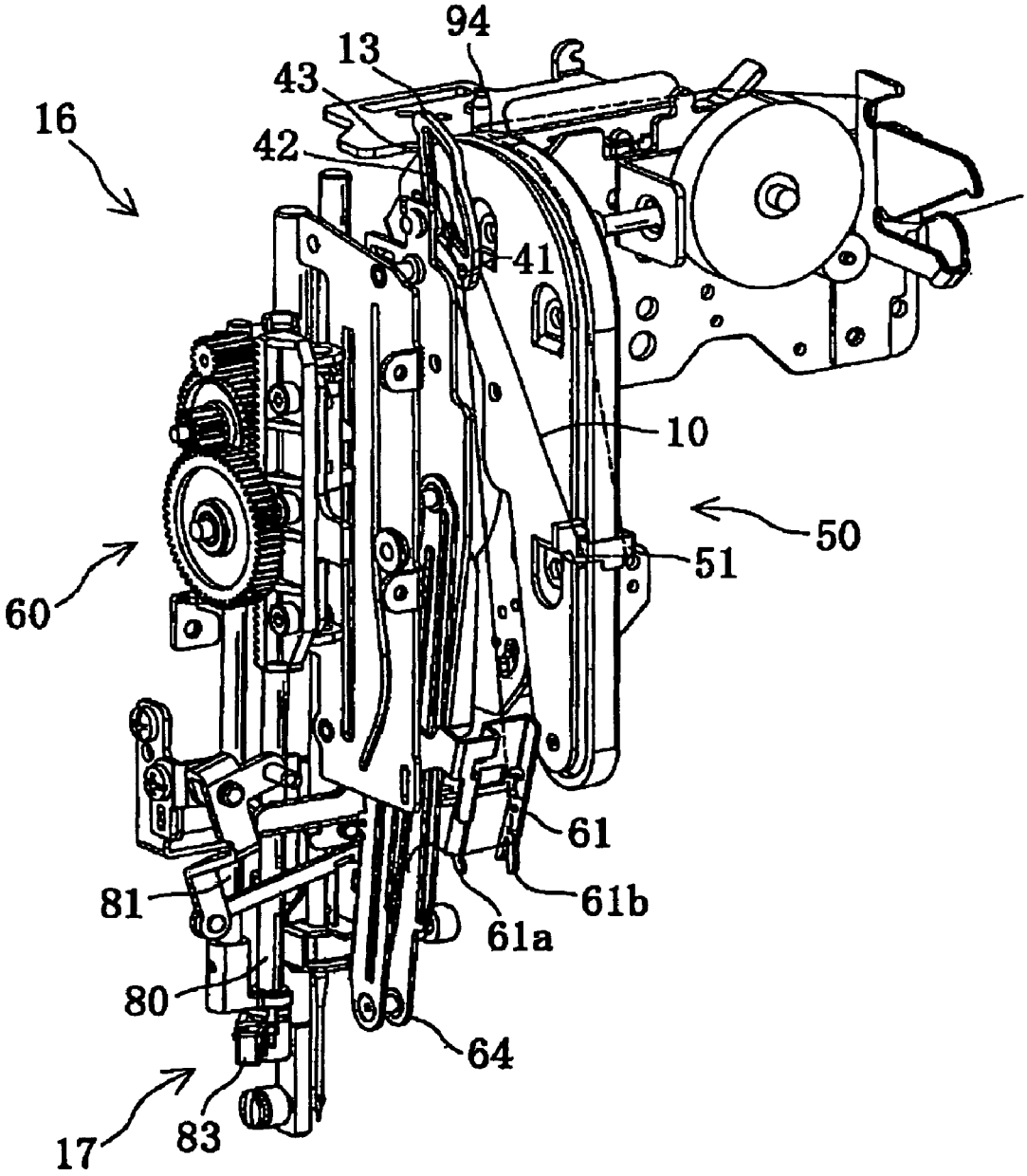
FIG. 14C is a perspective view of the automatic threading apparatus and automatic needle threader in a case where the thread take-up lever is threaded.
Figure 14D:
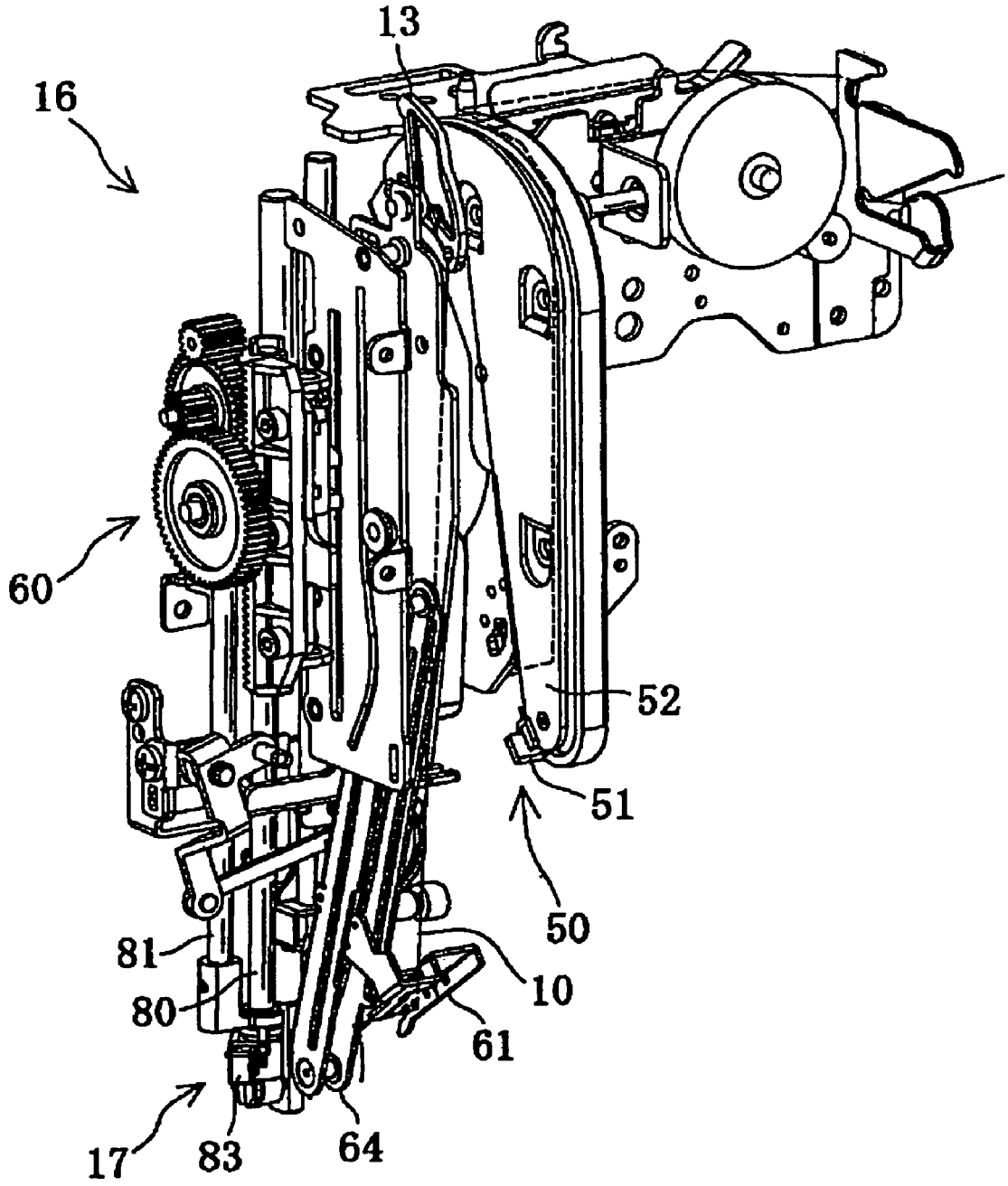
FIG. 14D is a perspective view of the automatic threading apparatus and automatic needle threader in a case where a take-up spring is threaded.
Figure 15A:
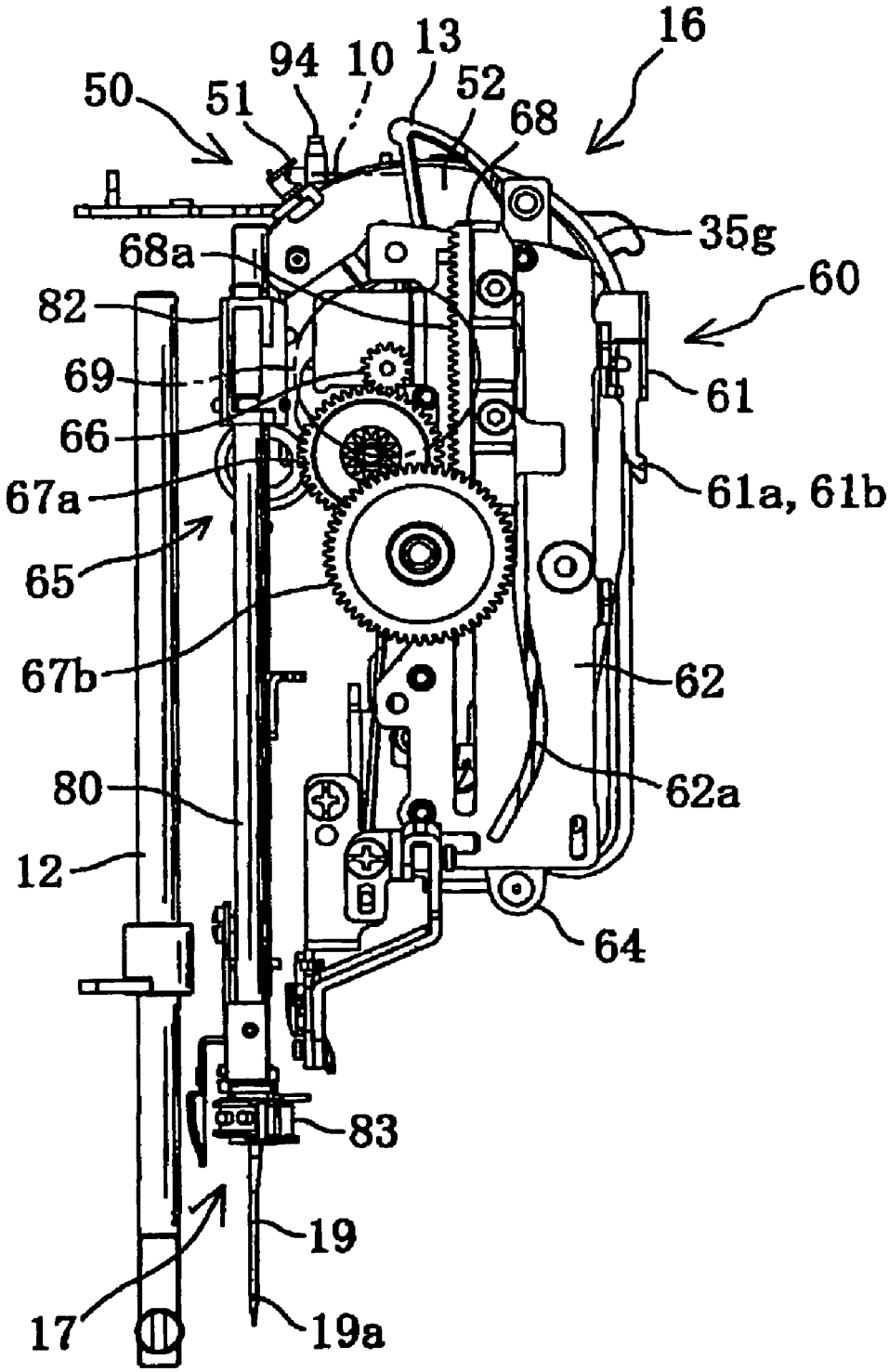
FIG. 15A is a side view of the automatic threading apparatus and automatic needle threader in a standby state.
Figure 15B:
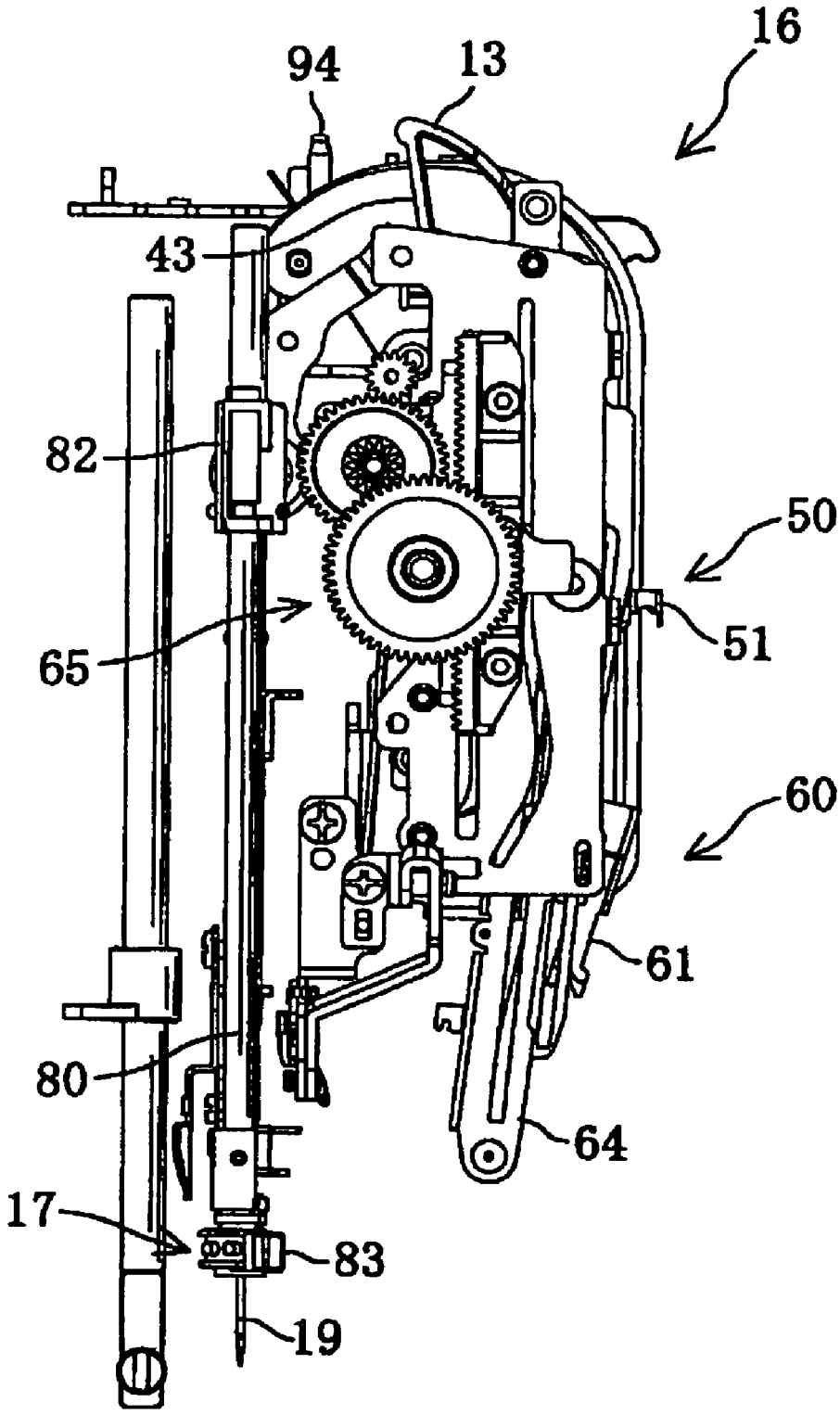
FIG. 15B is a side view of the automatic threading apparatus and automatic needle threader in a threading state.
Figure 15C:
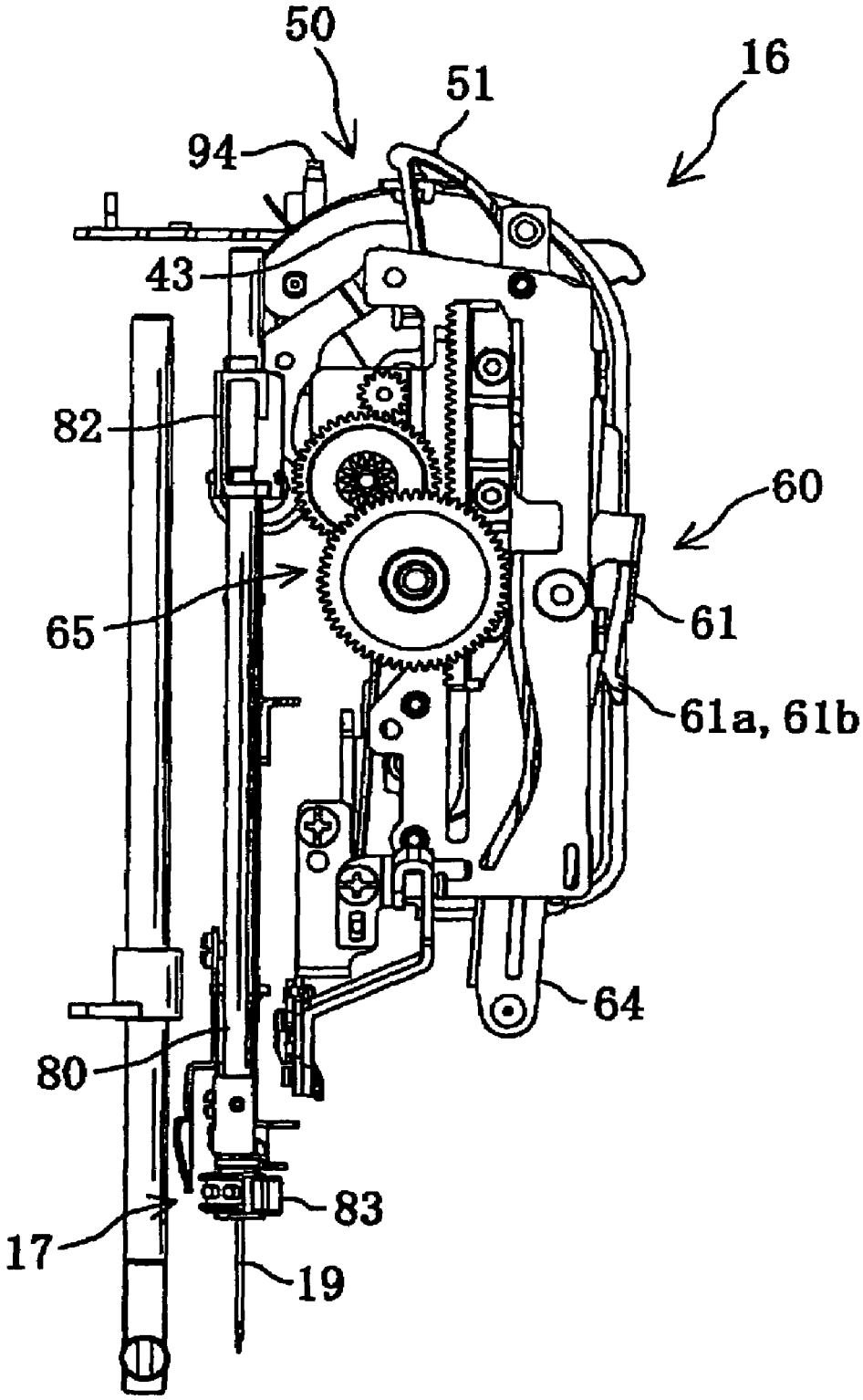
FIG. 15C is a side view of the automatic threading apparatus and automatic needle threader in a case where the thread take-up lever is threaded.
Figure 15D:
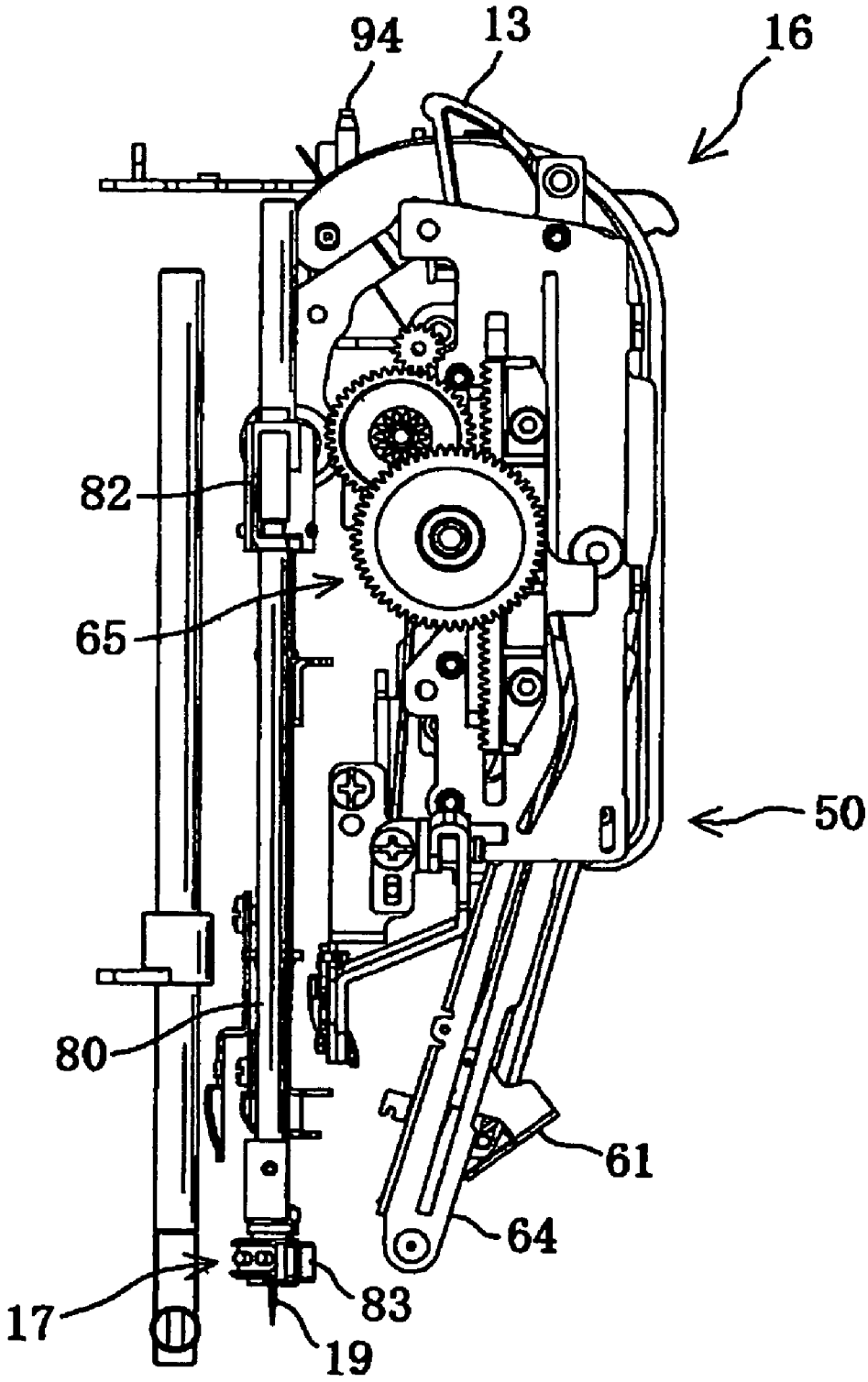
FIG. 15D is a side view of the automatic threading apparatus and automatic needle threader in a case where a take-up spring is threaded.

The first thread transferring mechanism 50 includes a first guide frame 52 fixed to the sewing machine frame, the first thread transferring member 51 supported on the first guide frame 52 so as to be movable between a standby position as shown in FIGS. 13A, 14A and 15A and a thread passing position as shown in FIGS. 13D, 14D and 15D and a first driving mechanism (not shown) driving the first thread transferring member 51. The first guide frame 52 is disposed on the right of the needle bar 11 and the thread take-up lever 13 and is a vertically long plate-shaped frame having faces directed right and left. The first guide frame 52 includes an upper edge formed into a circularly arc shape with a large diameter, a vertically long linear front edge and a lower edge formed into a circularly arc shape with a small diameter. A band-shaped thread introducing cover 35*g* is fixed along the upper, front and lower edges.

The thread tension regulator 14 and the take-up spring 15 are disposed on the right of the first guide frame 52. The thread tension regulator 14 includes a pair of thread tension discs 14*a* and 14*b* mounted on a thread tension shaft 14*c* further mounted on the upper end of the first guide frame 52. The take-up spring 15 is mounted on the lower end of the first guide frame 52. The first guide frame 52 has a notch 52*a* formed in a lower portion thereof so as to extend upward from the lower end thereof. The take-up spring 15 confronts the notch 52*a*. The take-up spring 15 reliably functions as a result of provision of the notch 52*a*.

The standby position of the first thread transferring member 51 is located at the rear of the upper end of the first guide frame 52 as shown in FIGS. 13A, 14A and 15A. The thread passing position of the first thread transferring member 51 is located at the rear of the lower end of the first guide frame 52. The first thread transferring member 51 is moved between the standby and thread passing positions along the upper, front and lower edges of the first guide frame 52. The first thread transferring member 51 has a thread catching portion located at the surface side of the thread-introducing cover 35*g*. The first thread transferring member 51 has legs engaging the edge of the first guide frame 52 thereby to be supported.

When moved from the standby position to the thread passing position, the first thread transferring member 51 catches the needle thread 10 passed through the first thread preparatory path 30, transferring the needle thread 10 downward. The needle thread 10 located upstream relative to the first thread transferring member 51 is passed through the thread tension regulator 14. When the first thread transferring member 51 has been moved to the thread passing position, the needle thread 10 caught by the first thread transferring member 51 is caused to pass the lower end of first guide frame 52 from the front to the rear. The needle thread 10 is then drawn by the second thread transferring member 61, whereupon the needle thread 10 is introduced from the lower end to the notch 52*a* to be passed through the take-up spring 15.

The first driving mechanism includes an endless wire connected to the first thread transferring member 51 and a plurality of guide rollers guiding a part of the wire along the upper, front and lower edges of the first guide frame 52 to mount the wire to the first guide frame 52. The wire is drawn by the first pulse motor 54 so that the first thread transferring member 51 is moved between the standby position and the thread passing position.

A thread tension regulating mechanism 55 including the thread tension regulator 14 will be described. The thread tension regulating mechanism 55 includes a pair of the thread tension discs 14*a* and 14*b* pinching the needle thread 10 therebetween to impart tension to the needle thread 10, a spring (not shown) pressing the thread tension discs 14*a* and 14*b*, an adjusting mechanism (not shown) varying the spring force of the spring thereby to adjust the spring force, and a thread tension pulse motor 59 actuating the adjusting mechanism. The adjusting mechanism is driven by the thread tension pulse motor 59 so that the thread tension discs 14*a* and 14*b* are pressed against each other during sewing and so that the thread tension discs 14*a* and 14*b* are released from the pressed state.

Figure 13E:
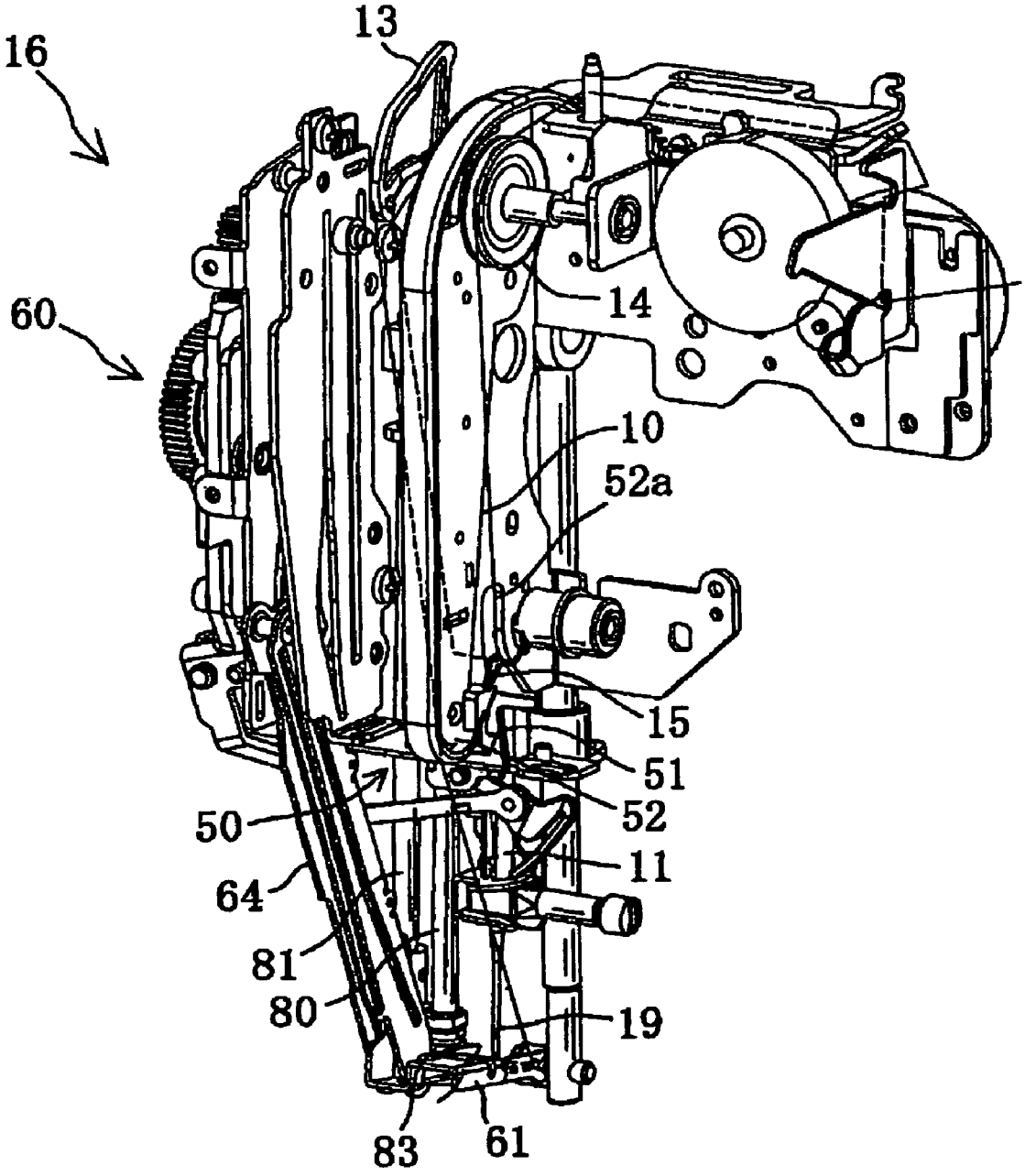
FIG. 13E is a perspective view of the automatic threading apparatus and automatic needle threader in a case where the needle thread is passed.
Figure 14E:
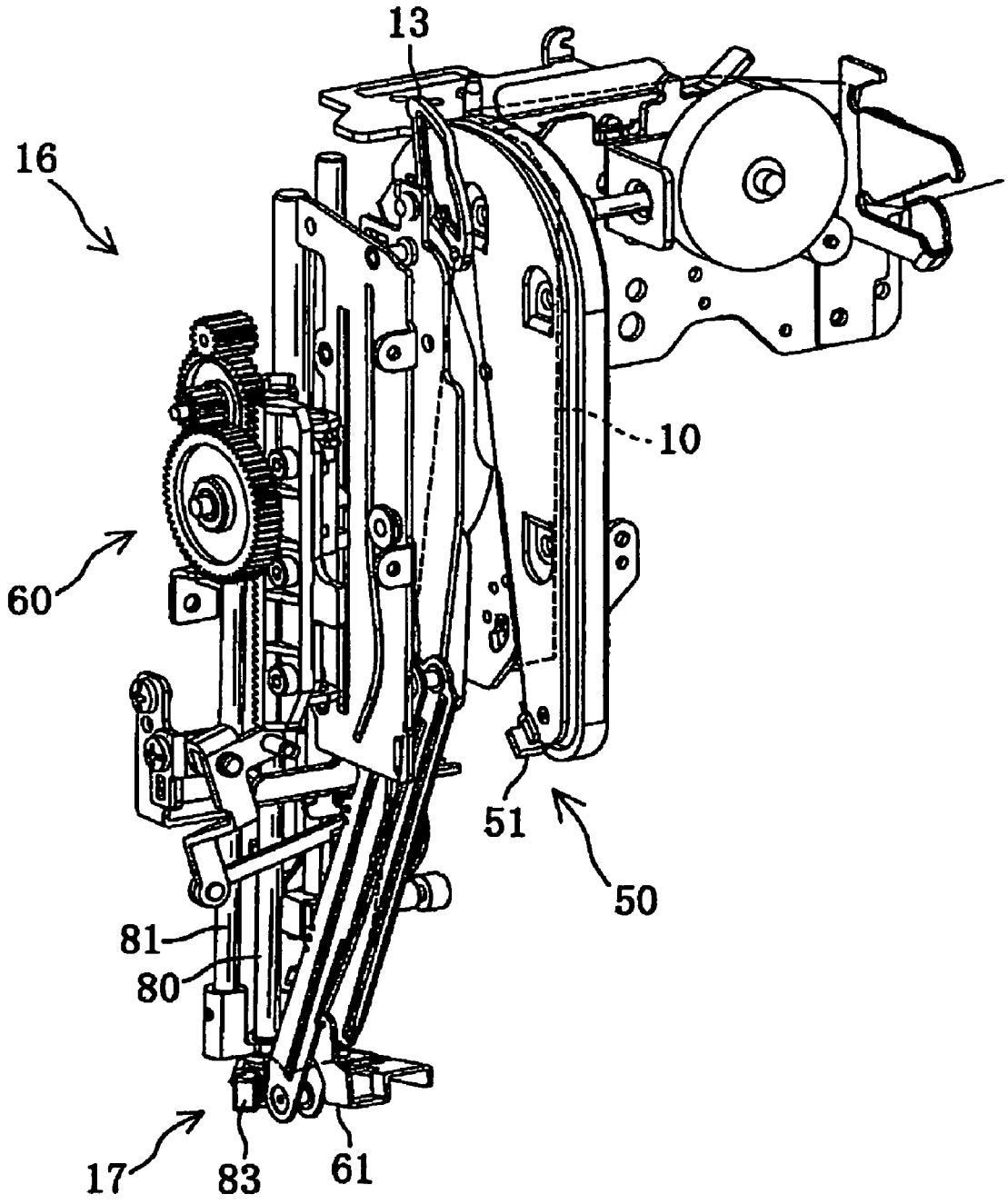
FIG. 14E is a perspective view of the automatic threading apparatus and automatic needle threader in a case where the needle thread is passed.
Figure 15E:
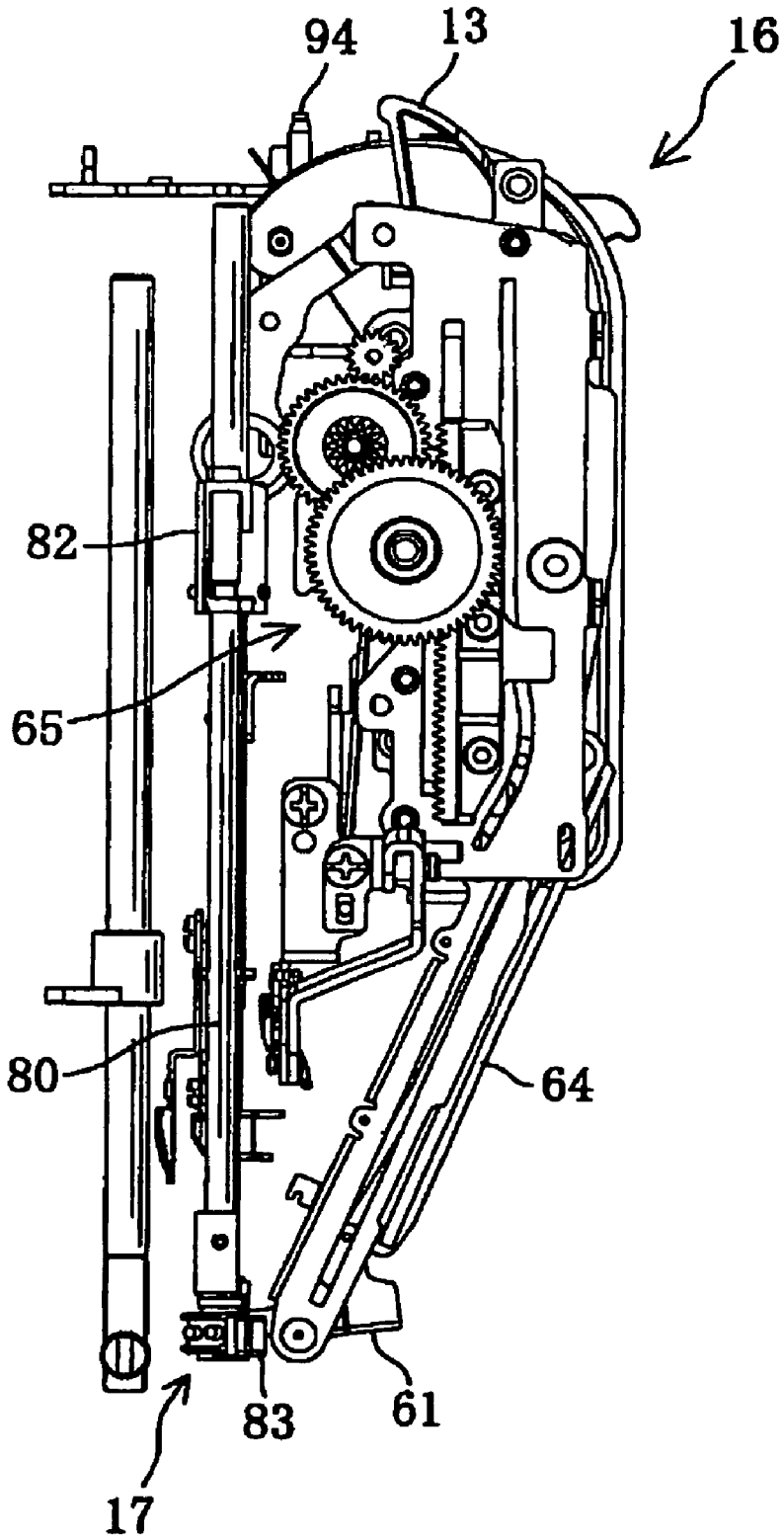
FIG. 15E is a side view of the automatic threading apparatus and automatic needle threader in a case where the needle thread is passed.

The second thread transferring mechanism 60 includes two right and left second guide frames 62 and 63 fixed to the sewing machine frame, a movable frame 64 supported on the second guide frames 62 and 63, the second thread transferring member 61 supported on the movable frame 64, and a second driving mechanism 65 driving the movable frame 64 and the second thread transferring member 61. The movable frame 64 is movable between an exit/entrance position as shown in FIGS. 13A, 14A and 15A and a protruded position as shown in FIGS. 13E, 14E and 15E. The second thread transferring member 61 is movable between a standby position as shown in FIGS. 13A, 14A and 15A and a thread passing position as shown in FIGS. 13E, 14E and 15E with addition of the movement of the movable frame 64.

The second guide frames 62 and 63 are disposed on the left of the needle bar 12 and the thread take-up lever 13 and is a vertically long plate-shaped frame having faces directed right and left. The second guide frames 62 and 63 are spaced apart from each other so as to be opposed to each other. The movable frame 64 is provided between the second guide frames 62 and 63 so as to enter and exit the space between the second guide frames 62 and 63. The movable frame 64 includes a pair of right and left slender movable pieces connected so as to be opposed to each other. The second thread transferring member has a leg inserted between the movable pieces of the movable frame 64. The second guide frames 62 and 63 are formed with guide grooves 62*a* and 63*a* respectively. The movable frame 64 is guided into the guide grooves 62*a* and 63*a*. The paired movable pieces of the movable frame 64 are formed with guide grooves 64*a* respectively. The movable frame 64 is guided by the guide grooves 62*a* and 63*a*. The paired movable pieces of the movable frame 64 are formed with guide grooves 64*a* respectively. The second thread transferring member 61 is guided by the guide grooves 64*a*.

When assuming a standby position, the second thread transferring member 61 is located just in front of and below the thread take-up lever 13 further located at the first position as shown in FIGS. 13B, 14B and 15B. When assuming a thread-passing position, the second thread transferring member 61 is directed downward is located in front of the sewing needle 19 and rear-facing as shown in FIGS. 13E, 14E and 15E. The second thread transferring member 61 has a pair of left and right thread holding portions 61*a* and 61*b* capable of holding the needle thread 10 passed through the first thread preparatory path 30. Each of the thread holding portions 61*a* and 61*b* is bifurcated. A pinching piece releasably pinching the needle thread 10 is attached to the left thread holding portion 61*a* so as to be movable. When moved from the standby position to the thread-passing position, the second thread transferring member 61 holds the needle thread 10 having been passed through the first thread preparatory path 30, transferring downward. When the second thread transferring member 61 has been moved to the thread-passing position, the needle thread 10 is held in a horizontally stretched state in front of an eye 19*a* of the needle 19 by the second thread transferring member 61.

The second driving mechanism 65 includes a driving gear 66, 2-stage gears 67*a* and 67*b* and a rack-forming member 68. The driving gear 66, the 2-stage gears 67*a* and 67*b* and the rack-forming member 68 are disposed on the left of the second guide frame 62 together with the second pulse motor 69. The second pulse motor 69 is fixed to the sewing machine frame and has an output shaft to which the driving gear 66 is coupled. Each of the 2-stage gears 67*a* and 67*b* is rotatably mounted on the sewing machine frame. The driving gear 66 is in mesh engagement with a larger-diameter gear of the 2-stage gear 67*a*. A smaller-diameter gear of the 2-stage gear 67*a* is in mesh engagement with a larger-diameter gear of the 2-stage gear 67*b*. The rack-forming member 68 is guided by the second guide frames 62 and 63 so as to be moved up and down and a rack 68*a* which is in mesh engagement with a smaller-diameter pinion of the 2-stage gear 67*b*.

Upon drive of the second pulse motor 69, the driving force is transmitted via the driving gear 66, the 2-stage gears 67*a* and 67*b* and the rack 68*a* to the rack-forming member 68, whereupon the rack-forming member 68 is moved up and down. When the rack-forming member 68 is moved up and down, the movable frame 64 coupled via a plurality of pulleys and wires (not shown) to the rack-forming member 68 is moved at a speed about twice as high as the rack-forming member 68. With this, the second thread transferring member 61 coupled via a plurality of pulleys and wires (not shown) to the movable frame 64 is moved at a speed about twice as high as the movable frame 64 (that is, about four times higher than the rack-forming member 68).

The automatic threading apparatus 16 includes a third thread transferring mechanism 70 having a sickle-shaped third thread transferring member 71 which catches the needle thread 10 transferred toward the sewing needle 19 by the second thread transferring member 61 to transfer the needle thread 10 to the needle-bar thread guide 18 provided on the needle bar 11 and to pass the needle thread 10. The automatic threading apparatus 16 further includes a driving mechanism (not shown) driving the third thread transferring mechanism 70. A detailed description of the third thread transferring mechanism 70 will be eliminated.

The automatic needle threader 17 will be described. As shown in FIGS. 13A to 13F, 14A to 14F and 15A to 15F, the automatic needle threader 17 includes a vertically long needle threading shaft 80 provided just on the left needle bar 11 so as to be moved up and down, a vertically long needle threading guide shaft 81 provided just on the left of the needle threading shaft 80 so as to be moved up and down with the needle threading shaft 80 and a needle threading slider 82 fitted with upper ends of the needle threading shaft 80 and the needle threading guide shaft 81 so as to be moved up and down. The automatic needle threader 17 further includes a driving mechanism (not shown) moving the needle threading guide shaft 81 up and down, a hook mechanism 83 having a needle threading hook provided on a lower end of the needle threading shaft 80 so as to be insertable through the needle eye 19*a* and a rotating mechanism (not shown) rotating the needle threading shaft 80 about 90 degrees so that the needle threading hook of the hook mechanism 83 is inserted through the needle eye 19*a* when the needle threading shaft 80 assumes a descent limit position.

The automatic needle threader 17 is operated in synchronization with the second thread transferring mechanism 60 of the automatic threading apparatus 16. The needle threading shaft 80 reaches the descent limit position substantially simultaneously when the second thread transferring member 61 is moved to the thread-passing position. The needle threading hook of the hook mechanism 83 is rotated about 90 degrees so that the needle threading hook is passed through the needle eye 19*a*. The needle thread 10 held by the second thread transferring member 61 is then caught by the needle threading hook. Successively, the needle threading hook of the hook mechanism 83 is rotated about 90 degrees in the opposite direction so that the needle threading hook is returned through the needle eye 19*a*, whereby the needle thread 10 is passed through the needle eye 19*a*. Thereafter, the needle threading shaft and other components are moved up thereby to be returned to the respective original positions.

The first and second thread preparatory paths 30 and 32 will now be described. As described above, the needle thread is passed through the first thread preparatory path 30 in order that the needle thread 10 extending from the spool 9 may be ready to be passed through a plurality of thread guides (the thread tension regulator 14, the take-up spring 15, the thread take-up lever 13 and the like) by the automatic threading apparatus 16. The needle thread 10 is introduced from the first thread introducing groove 31 formed in the sewing machine cover 35 into the first thread preparatory path 30. The needle thread 10 is passed through the second thread preparatory path 32 in order that the needle thread 10 extending from the spool 9 may be ready to be manually passed through a plurality of thread guides. The needle thread 10 is introduced from the second thread introducing groove 33 formed in the sewing machine cover 35 into the second thread preparatory path 32.

The thread introducing front cover 35*b* has a lower right end which is recessed leftward into a recess 36 as shown in FIGS. B, 13A and 14A. Threading members 90 and 91 are provided in the recess 36 so as to confront the outside. A plate-shaped pretensioner 93 is provided between the first guide frame 52 and the threading member 91 inside the sewing machine cover 35. The pretensioner 93 is capable of pressing the needle thread 10 against a receiving plate 92 by a suitable pressing force. A shaft-like threading member 94 protrudes on the left of the pretensioner 93.

A thread guide 95 is provided just below the thread holding portion 61*b* on the right of the second thread transferring member 61 assuming the standby position and on the right of a movement locus of the second thread transferring member 61. The thread guide 95 serves to keep the needle thread 10 in slight engagement at a predetermined position in order that the needle thread 10 may be passed through the thread holding members 61*a* and 61*b* upon operation of the second thread transferring member 61. A thread guide 96 is provided so as to confront a vertical groove of an L-shaped introducing groove 34*d* between the thread guide cover 35*d* and the face plate 35*f*.

The needle thread 10 passed through the first thread preparatory path 30 will be treated as follows. The needle thread 10 is extended leftward from the spool 9 to be passed through the thread guide 90 from above. The needle thread 10 is then passed through a lower thread guide portion 91*a* of the thread guide 91 form below and further extended upward. The needle thread 10 is further passed through an upper protruding thread guide portion 91*b* from the front and is extended leftward through the right side and rear of the thread guide portion 91*b*. The needle thread 10 extending leftward from the upper protruding thread guide portion 91*b* further extends through a gap between the receiving plate 92 and the pretensioner 93 and is then passed through the shaft-like threading member 94 from behind. The needle thread 10 is then passed through the introducing guide portion 43 of the thread take-up lever 13 assuming the first position from behind. The needle thread 10 between the shaft-like threading member 94 and the introducing guide portion 43 is located near the upper end of the thread introducing cover 35*g*, whereupon the needle thread 10 is ready to be reliably passed through the first thread transferring member 51 moved from the standby position to the thread-passing position.

The needle thread 10 passed through the introducing guide portion 43 of the thread take-up lever 13 is extended frontward and downward and passed through the thread guide 95 and then extended leftward. The needle thread 10 is then passed through a lower thread guide portion 96*a* of a thread guide 96 and extended upward. The needle thread 10 is further passed through an upper thread guide portion 96*b* of the thread guide 96 and then held. A downstream end of the needle thread 10 is cut off by a cutter 97 mounted on the thread guide 96. The needle thread 10 between the thread guides 95 and 96 extends in a movement path of a paired thread holding portions 61*a* and 61*b* of the second thread transferring member 61. Thus, the needle thread 10 is reliably passed through the paired thread holding portions 61*a* and 61*b* of the second thread transferring member 61 thereby to be held.

The sewing machine M operates as follows. Assume now a case where the needle thread 10 extending from the spool 9 attached to the spool bar 8 is passed through a plurality of thread guides (the thread tension regulator 14, the take-up spring 15, the thread take-up lever 13 and the like) and further passed through the needle eye 19*a* so that sewing can be executed, when the needle thread 10 set on the sewing machine M has been cut off or a spool 9 is exchanged from one to another. In this case, the needle thread 10 can be passed through the thread guides and the needle eye automatically or manually.

Firstly, automatic threading and needle threading of the needle thread 10 will be described. The automatic threading preparatory switch 23 is turned on so that the thread take-up lever 13 not assuming the first position is automatically moved to the first position and then stopped. Alternatively, the pulley connected to the main shaft is manually rotated so that the thread take-up lever 13 is moved to the first position.

In this case, it is preferable that an indication corresponding to the first position is provided on the pulley and a part of the sewing machine cover 35 located near the pulley in order that the thread take-up lever 13 may reliably be positioned at the first position.

Subsequently, the needle thread 10 extending from the spool 9 is inserted into the first thread introducing groove 31 in a sequence of the introducing grooves 34*a*, 34*b*, 34*c* and 34*d*. The needle thread 10 is finally returned so as to straddle the thread guide 96 confronting the vertical groove of the introducing groove 34*d*. The needle thread 10 is then passed through the upper thread holding member 96*b* of the thread guide 96 thereby to be held. The downstream part of the needle thread 10 is cut off by the cutter 97. As a result, the needle thread 10 inserted into the first thread introducing groove 31 is passed through the first thread preparatory path 30 by the first thread introducing groove 31.

As shown in FIGS. 13A, 14A and 15A, the needle thread 10 set in the first thread preparatory path 30 is particularly caused to pass the movement locus of the first thread transferring member 51 and then passed through the introduction guide portion 43 of the thread take-up lever 13 assuming the first position and is further caused to pass a movement path of the paired thread holding portions 61*a* and 61*b* of the second thread transferring member 61. Subsequently, when the automatic threading start switch 25 is turned on, the automatic threading apparatus 16 and the automatic needle threader 17 are operated so that the needle thread 10 set in the first thread preparatory path 30 is automatically passed through a plurality of thread guides (the thread tension regulator 14, the take-up spring 15, the thread take-up lever 13 and the like) and further passed through the needle eye 19*a*. At this time, the thread tension discs 14*a* and 14*b* of the thread tension regulator 14 are open.

In this case, the first and second pulse motors 54 and 69 are driven substantially simultaneously to drive the first and second thread transferring members 50 and 60 so that the first and second thread transferring members 51 and 61 are moved from the standby positions toward the thread-passing positions, respectively. As a result, firstly, the needle thread 10 between the shaft-like threading member 94 and the introduction guide portion 43 of the thread take-up lever 13 is caught by the first thread transferring member 51, as shown in FIGS. 13B, 14B and 15B. The needle thread 10 between the thread guides 95 and 96 is caught by the paired thread holding portions 61*a* and 61*b* of the second thread transferring member 61 from above to be held.

Subsequently, the first thread transferring member 51 is moved downward with the needle thread 10 being caught whereas the second thread transferring member 61 is moved downward with the needle thread 10 being held. In this case, the needle thread 10 is drawn by the first and second thread transferring members 51 and 61 as shown in FIGS. 13C, 14C and 15C. The needle thread 10 between the thread transferring members 51 and 61 includes a part passed through the introduction guide portion 43 of the thread take-up lever 13 from behind. This part of the needle thread 10 passed through the introduction guide portion 43 is guided to the lever thread introducing portion 42 by the introduction guide portion 43, whereupon the needle thread 10 is introduced into and passed through the lever threading portion 41 by the lever thread introducing portion 42. Furthermore, the needle thread 10 extending from the shaft-like threading member 94 to the first thread transferring member 51 is introduced into a gap between the paired thread tension discs 14*a* and 14*b* of the open thread tension regulator 14.

Subsequently, after having been moved downward, the first thread transferring member 51 is further moved to the rear of the arc lower portion of the first guide frame 52 thereby to reach the thread-passing position, as shown in FIGS. 13D, 14D and 15D. In this case, the needle thread 10 caught by the first thread transferring member 51 passes the lower end of the first guide frame 52 from the front to the rear. The second thread transferring member 61 assumes a position in front of the thread-passing position immediately after the first thread transferring member 51 has reached the thread-passing position. When the second thread transferring member 61 has been moved from the aforesaid position to the thread-passing position, the upstream needle thread 10 is drawn downstream.

Figure 13F:
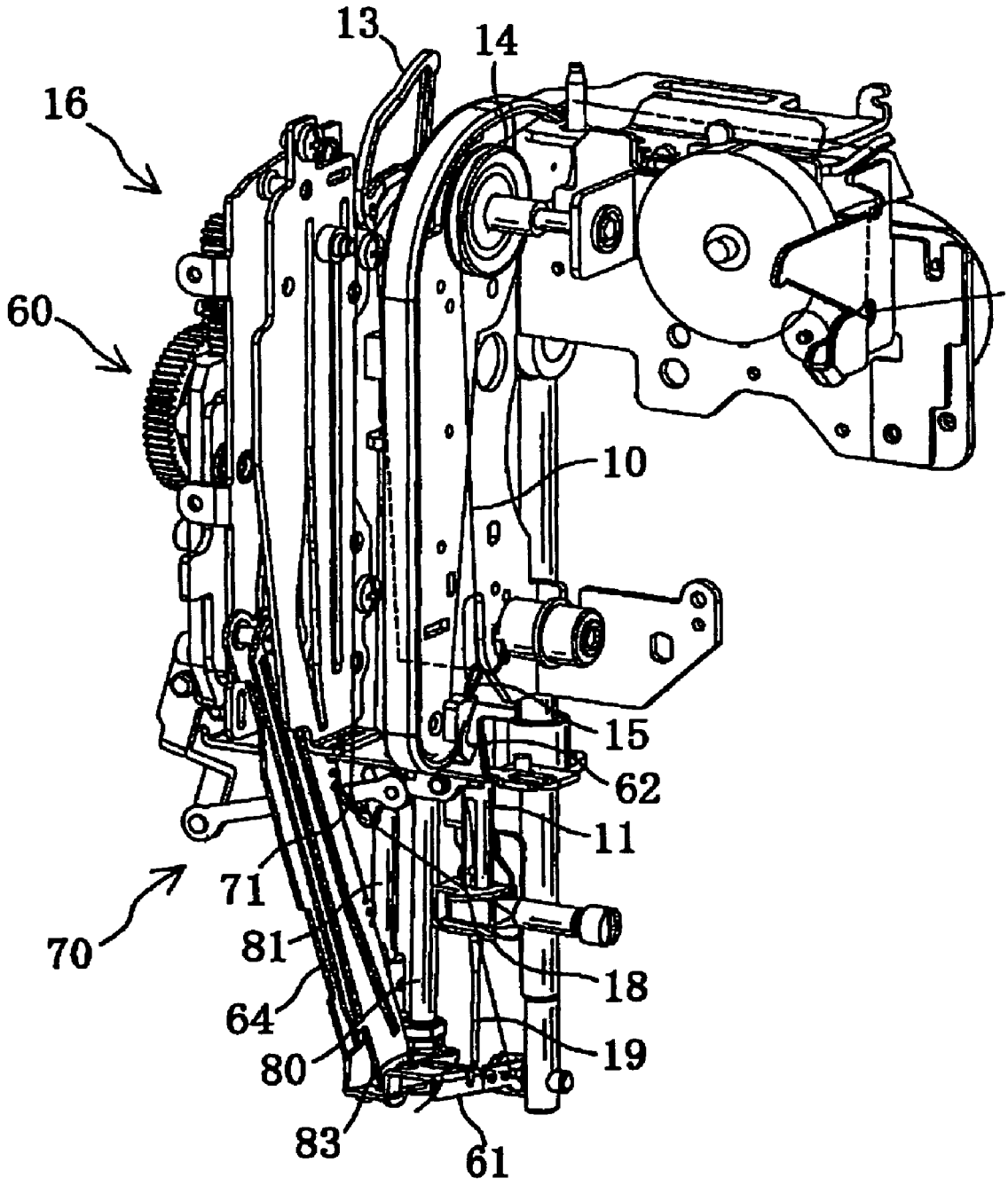
FIG. 13F is a perspective view of the automatic threading apparatus and automatic needle threader in a case where a thread guide of the needle bar is threaded.
Figure 14F:
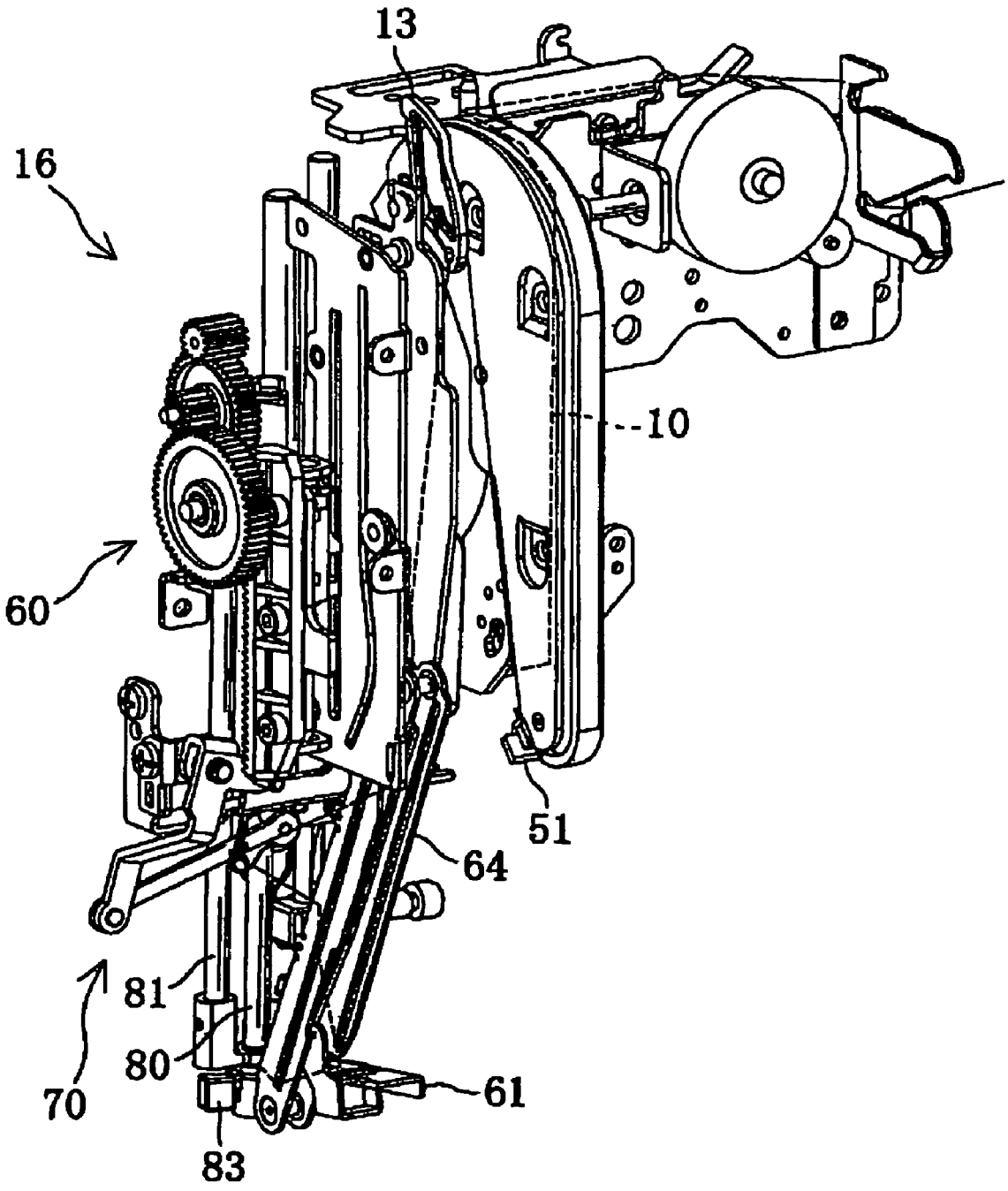
FIG. 14F is a perspective view of the automatic threading apparatus and automatic needle threader in a case where a thread guide of the needle bar is threaded.
Figure 15F:
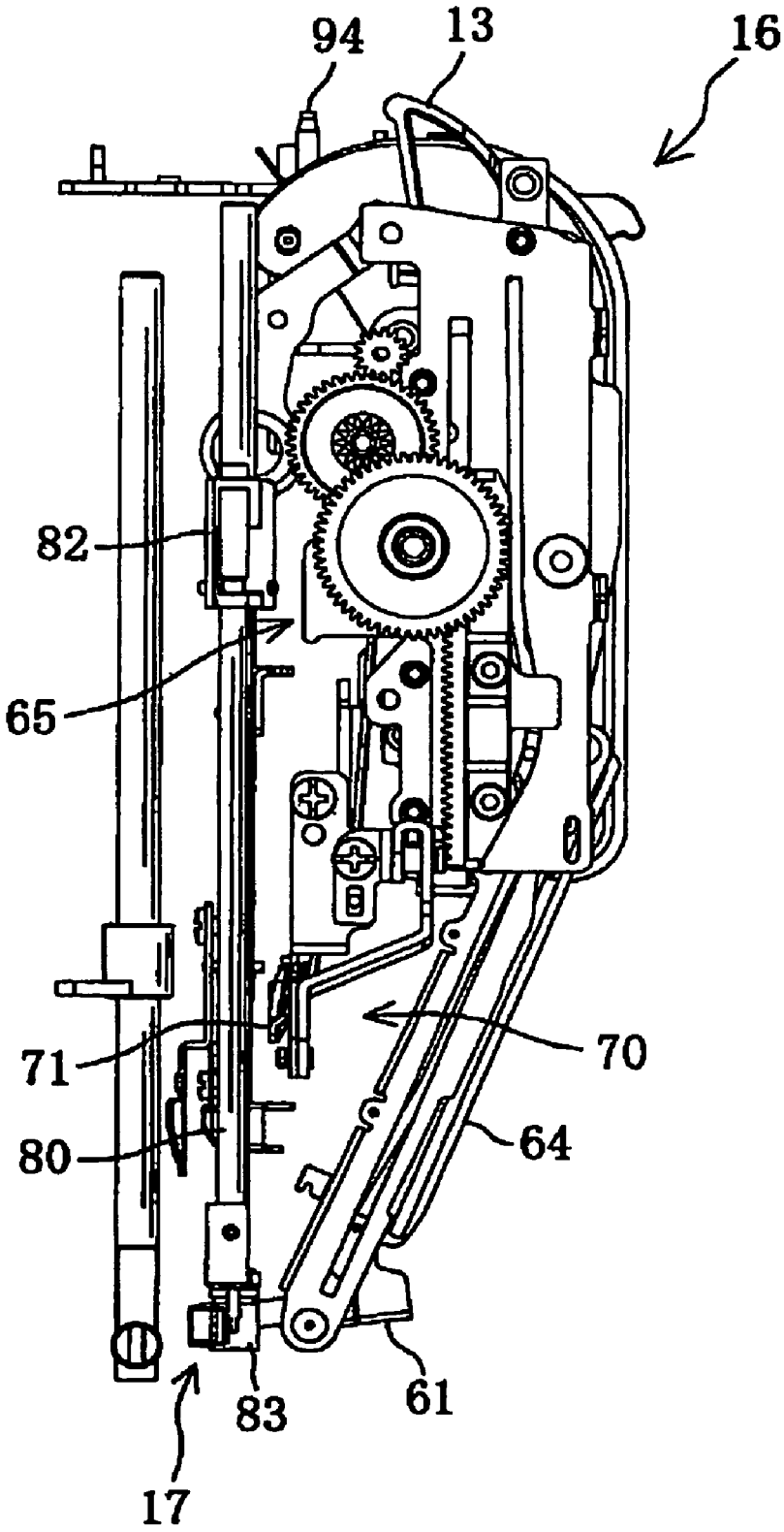
FIG. 15F is a side view of the automatic threading apparatus and automatic needle threader in a case where a thread guide of the needle bar is threaded.

More specifically, as shown in FIGS. 13E, 14E and 15E, when the second thread transferring member 61 has reached the thread-passing position, the needle thread 10 having passed the lower end of the first guide frame 52 from the front to the rear is raised thereby to be introduced into the notch 52*a* and then passed through the take-up spring 15. Furthermore, when the second thread transferring member 61 has reached the thread-passing position, the needle thread 10 is held in a stretched state in front of the needle eye 19*a* by the second thread transferring member 61. Thereafter, as shown in FIGS. 13F, 14F and 15F, the third thread transferring mechanism 70 is operated so that the needle thread 10 transferred toward the sewing needle 19 by the second thread transferring member 61 is caught by the third thread transferring member 71. The needle thread 10 is then transferred to the needle-bar thread guide 18 provided on the needle bar 11 and passed through needle bar 11.

On the other hand, the automatic needle threader 17 starts substantially simultaneously with the automatic threading apparatus 16. As shown in FIGS. 13A to 13F, 14A to 14F and 15A to 15F, the needle threading shaft 80 and the needle threading guide 81 are moved downward together with the needle threading slider 82 in synchronization with downward movement of the second thread transferring member 61. When the second thread transferring member 61 reaches the thread-passing position, the downward movement of the needle threading shaft 80 and the needle threading guide 81 is stopped and the needle threading hook of the hook mechanism 83 is on a level with the needle eye 19*a*. Subsequently, when the needle threading slider 82 is further moved downward about a vertical axis by a rotating mechanism so that the needle thread is passed through the needle eye 19*a* and the needle thread held by the second thread transferring member 61 is caught by the needle threading hook of the hook mechanism 83.

Thereafter, the needle threading hook of the hook mechanism 83 is rotated in the opposite direction so as to be returned through the needle eye 19*a*, whereby the needle thread 10 is passed through the needle eye 19*a*. Thereafter, the needle threading slider 82, the needle threading shaft 80 and the needle threading guide 81 are moved upward to respective original positions. Furthermore, the first and second thread transferring members 51 and 61 are also returned to respective original positions, whereupon the sewing machine M is in a sewing executable condition.

Next, manual threading and needle threading will be described. The manual threading preparatory switch 24 is turned on so that the thread take-up lever 13 not assuming the second position is automatically moved to the second position and then stopped. Alternatively, the pulley connected to the main shaft is manually rotated so that the thread take-up lever 13 is moved to the second position. In this case, it is preferable that an indication corresponding to the second position is provided on the pulley and a part of the sewing machine cover 35 located near the pulley in order that the thread take-up lever 13 may reliably be positioned at the second position.

Subsequently, the needle thread 10 extending from the spool 9 is inserted by an operator into the second thread introducing groove 33 formed in the sewing machine cover 35 in a sequence of the introducing grooves 34*a*, 34*b*, 34*c* and 34*d*. In this case, the needle thread 10 is passed through the threading member 91 and the shaft-like threading member 94. However, the thread take-up lever 13 assumes the second position located lower than the first position, and the introducing groove 34*c* is formed into a downwardly rightward curved shape. Accordingly, when introduced from the introducing groove 34*c* is moved downward in contact with the escape guide portion 44 of the thread take-up lever 13, the needle thread 10 is guided out of the thread take-up lever 13 by the escape guide portion 44, and the needle thread 10 extending from the shaft-like threading member 94 is passed through the thread tension regulator 14 but not the thread take-up lever 13.

Subsequently, the needle thread 10 is passed through the rear side of the lower end of the thread-introducing cover 35*g* and the lower end of the first guide frame 52 to be returned. Successively, the needle thread 10 is inserted into the introducing grooves 34*f* and 34*g* in turn and then moved upward. In this case, the needle thread 10 passed through the lower end of the first guide frame 52 is moved upward and introduced into the notch 52*a* to be passed through the take-up spring 15. In a case where the needle thread 10 is moved upward along the introducing groove 34*c*, the needle thread 10 extending downstream from the take-up spring 15 is guided out of the thread take-up lever 13 when moved upward in contact with the escape guide 44 of the thread take-up lever 13. Furthermore, when moved to the uppermost position of the introducing groove 34*c*, the needle thread 10 extending from the take-up spring 15 passes the first thread engagement portion 46 provided at the rear end of the escape guide 44 and is guided to a position where the needle thread 10 is in contact with a substantially central part of the introduction guide portion 43, as viewed at a side. In this case, as viewed at the front, the needle thread 10 extending from the take-up spring 15 is in contact with the right rear ridge of the introduction guide portion 43 and is guided toward the introducing groove 34*c* located on the left of and over the first thread engagement portion 46.

Subsequently, the needle thread 10 is manually moved downward along the introducing grooves 34*c*, 34*g* and 34*f*. When moved downward along the introducing groove 34*c*, the needle thread 10 in contact with the right rear ridge of the introduction guide portion 43 as viewed at the front is moved toward the first thread engagement portion 46 to be engaged with the first thread engagement portion 46. Furthermore, when the operator moves the needle thread 10 downward along the introducing groove 34*f*, the needle thread 10 is drawn downward, turning behind the first thread engagement portion 46 (leftward in FIG. 9) and passing to the left from the left rear ridge (see FIG. 12) as viewed at the front. Thereafter, the needle thread 10 engaged with the first thread engagement portion 46 is again moved downward along the introduction guide portion 43 and guided by the lever thread introducing portion 42 and introduced into and passed through the lever threading portion 41. Subsequently, the operator passes the needle thread 10 through the needle-bar thread guide 18 and then through the needle eye 19*a* (manual needle threading). Consequently, the sewing machine M is in a sewing executable condition.

The above-described sewing machine M is provided with the first preparatory path 30, the first introduction groove 31, the second preparatory path 32 and the second introduction groove 33. Accordingly, the needle thread 10 extending from the spool 9 is introduced from the first introduction groove 31 into and passed through the first preparatory path 30 for preparation. The needle thread 10 can automatically be transferred and passed through a plurality of thread guides (the thread tension regulator 14, the take-up spring 15, the thread take-up lever 13 and the like) by the automatic threading apparatus 16. Furthermore, the needle thread 10 extending from the spool 9 is manually introduced from the second introduction groove 33 into and passed through the second preparatory path 32 for preparation. The needle thread 10 can be passed through a plurality of thread guides.

More specifically, the needle thread 10 can automatically be passed through a plurality of thread guides by the automatic threading apparatus 16, and the needle thread 10 can manually be passed through a plurality of thread guides readily and reliably. For example, even when the automatic threading apparatus 16 has failed, the needle thread 10 can manually be passed through a plurality of thread guides readily and reliably. Consequently, sewing can be carried out smoothly. Furthermore, since the manual threading can be executed without opening the sewing machine cover 35, a troublesome opening and closing the sewing machine cover 35 is not necessary. Further, there is no possibility that foreign matter may fall into the sewing machine interior, resulting in a cause of failure.

Furthermore, in the foregoing embodiment, a part of the first preparatory path 30 is common to a part of the second preparatory path 32, and a part of the first introduction groove 31 is common to a part of the second introduction groove 33. Accordingly, passing the needle thread 10 through the first or second preparatory path 30 or 32 can readily be carried out using the common preparatory path and introduction groove. Furthermore, since each of the first and second preparatory paths 30 and 32 and the first and second introduction grooves 31 and 33 has a simple construction, a good appearance of the sewing machine can be provided and the construction is advantageous in the production cost.

Furthermore, in the foregoing embodiment, the thread take-up lever 13 includes the lever threading portion 41 through which the needle thread 10 is passed so that sewing can be carried out, the lever thread introducing portion 42 introducing the needle thread 10 to the lever threading portion 41, the introduction guide portion 43 guiding the needle thread 10 to the lever thread introducing portion 42 and the escape guide portion 44 capable of guiding the needle thread 10 outside the thread take-up lever 13 so that the needle thread 10 is manually passed through the take-up spring 15. Accordingly, the needle thread 10 extending from the spool 9 is drawn while being passed through the introduction guide portion 43, whereby the needle thread 10 is guided to the lever thread introducing portion 42 by the introduction guide portion 43. As a result, the needle thread 10 can reliably be introduced to and passed through the lever threading portion 41 by introduction guide portion 43. Furthermore, when the needle thread 10 is manually passed through the thread tension regulator 14 and the take-up spring 15 both of which are located upstream relative to the thread take-up lever 13, the needle thread 10 is guided out of the thread take-up lever 13 by the escape guide portion 44 and passed through the thread tension regulator 14 and the take-up spring 15 both of which are located upstream relative to the thread take-up lever 13. Thereafter, the needle thread 10 is passed through the introduction guide portion 43. Thus, the needle thread 10 can be passed through the lever threading portion 41 by the introduction guide portion 43 and the introduction guide portion 43.

Furthermore, in the foregoing embodiment, the escape guide portion 44 is formed to connect the distal end of the introduction guide portion 43 and the lever distal end (the distal end of the thread take-up lever body) provided with the lever threading portion 41, and the escape guide portion 44 is formed into the outwardly expanded arc shape. Consequently, when the needle thread 10 is manually passed through the thread tension regulator 14 and the take-up spring 15 both of which are located upstream relative to the thread take-up lever 13, the needle thread 10 can be guided out of the thread take-up lever 13 by the escape guide portion 44 smoothly and reliably without being passed through the lever threading portion 41. And, thereafter, when passed through the lever threading portion 41, the needle thread 10 can be introduced to the introduction guide portion 43 smoothly and reliably.

Furthermore, in the foregoing embodiment, the needle thread 10 can be passed through the first preparatory path 30 when the position of the thread take-up lever 13 has been changed to the first position near the rise limit position. Consequently, the needle thread 10 having been passed through the first preparatory path 30 can be passed through a plurality of the thread guides by the automatic threading apparatus 16. Furthermore, since the needle thread 10 is capable of being passed through the second preparatory path 32 when the thread take-up lever 13 has been changed to the second position lower than the first position, the needle thread 10 can manually be passed through the second preparatory path 32, whereupon the needle thread 10 can be passed through a plurality of the thread guides. More specifically, when the position of the thread take-up lever 13 is changed in a range of reciprocal swing, the needle thread 10 can be passed through the first preparatory path 30 (automatic threading) and can be passed through the second preparatory path 32 (manual threading).

Furthermore, in the foregoing embodiment, the automatic threading apparatus 16 includes the first thread transferring mechanism 50 having the first thread transferring member 51 transferring the needle thread 10 to a plurality of the thread guides including the thread take-up lever 13 and the first pulse motor 54 driving the first thread transferring mechanism 50. Accordingly, when the first thread transferring mechanism 50 is driven by the pulse motor 54, the needle thread 10 set in the first preparatory path 30 can automatically be transferred to and passed through a plurality of the thread guides including the thread take-up lever 13 reliably.

Furthermore, the automatic threading apparatus 16 further includes the second thread transferring mechanism 60 having the second thread transferring member 61 and the second pulse motor 69 (corresponding to a second driver) driving the second thread transferring mechanism 60. Consequently, when the second thread transferring mechanism 60 is driven by the second pulse motor 69, the needle thread 10 located downstream relative to the thread take-up lever 13 can automatically be transferred by the second thread transferring member 61 of the second thread transferring mechanism 60, and the needle thread 10 can automatically be passed through the eye 19*a* of the needle 19 by the automatic needle threader 17.

The invention should not be limited to the foregoing embodiment. The embodiment may be modified or expanded without departing from the scope of the invention. For example, each of the first thread transferring mechanism, second thread transferring mechanism and the automatic needle threader may be driven manually. Furthermore, the invention may be applied to various types of household and industrial sewing machines.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A sewing machine comprising:

a needle bar reciprocally movable up and down, the needle bar capable of carrying a sewing needle attached thereto;

a thread take-up lever reciprocally swingable up and down;

a thread supply which supplies a needle thread to the needle bar carrying the sewing needle;

a plurality of thread guides including the thread take-up lever;

an automatic threading apparatus automatically carrying the needle thread extending from the thread supply and passing the needle thread through the thread guides including the thread take-up lever;

wherein the plurality of thread guides define a first preparatory path provided for threading so that the needle thread extending from the thread supply can be passed through the thread guides by the automatic threading apparatus; and wherein the plurality of thread guides define a second preparatory path provided for threading so that the needle thread extending from the thread supply can manually be passed through the thread guides, wherein the thread take-up lever is displaced within a range of reciprocal swing so that threading is possible for at least one of the first and second preparatory paths.

2. A sewing machine comprising:

a needle bar reciprocally movable up and down, the needle bar capable of carrying a sewing needle attached thereto;

a thread take-up lever reciprocally swingable up and down;

a thread supply which supplies a thread to the needle bar carrying the sewing needle;

a plurality of thread guides including the thread take-up lever;

an automatic threading apparatus automatically carrying the needle thread extending from the thread supply and passing the needle thread through the thread guides including the thread take-up lever;

wherein the plurality of thread guides define a first preparatory path provided for threading so that the needle thread extending from the thread supply can be passed through the thread guides by the automatic threading apparatus;

a sewing machine cover;

a first thread introducing groove formed in the sewing machine cover so as to be capable of introducing the needle thread to the first preparatory path;

wherein the plurality of thread guides define a second preparatory path provided for threading so that the needle thread extending from the thread supply can manually be passed through the thread guides; and a second thread introducing groove formed in the sewing machine cover so as to be capable of introducing the needle thread to the second preparatory path.

3. The sewing machine according to claim 2, wherein the first preparatory path includes at least a part thereof common to at least a part of the second preparatory path, and the first thread introducing groove includes at least a part thereof common to at least a part of the second thread introducing groove.

4. The sewing machine according to claim 1, wherein the thread take-up lever includes a lever threading portion through which the needle thread is passed so as to be able to be sewn, a lever thread introducing portion introducing the needle thread to the lever threading portion, an introduction guide portion guiding the needle thread to the lever thread introducing portion and an escape guide portion capable of guiding the needle thread outside the thread take-up lever so that the thread is manually passed through at least one of the thread guides located upstream relative to the thread take-up lever.

5. The sewing machine according to claim 2, wherein the thread take-up lever includes a lever threading portion through which the needle thread is passed so as to be able to be sewn, a lever thread introducing portion introducing the needle thread to the lever threading portion, an introduction guide portion guiding the needle thread to the lever thread introducing portion and an escape guide portion capable of guiding the needle thread outside the thread take-up lever so that the thread is manually passed through at least one of the thread guides located upstream relative to the thread take-up lever.

6. The sewing machine according to claim 4, wherein the introduction guide portion has a distal end, the thread take-up lever has a distal end on which the lever threading portion is provided and the escape guide portion is formed so as to join the distal end of the introduction guide portion and the distal end of the thread take-up lever to each other.

7. The sewing machine according to claim 5, wherein the introduction guide portion has a distal end, the thread take-up lever has a distal end on which the lever threading portion is provided and the escape guide portion is formed so as to join the distal end of the introduction guide portion and the distal end of the thread take-up lever to each other.

8. The sewing machine according to claim 6, wherein the escape guide portion is formed into an outwardly expanded arc shape.

9. The sewing machine according to claim 7, wherein the escape guide portion is formed into an outwardly expanded arc shape.

10. The sewing machine according to claim 1, wherein the needle thread is allowed to pass through the first preparatory path when a position of the thread take-up lever has been switched to a first position near a rise limit position thereof, and the needle thread is allowed to pass through the second preparatory path when the position of the thread take-up lever has been switched to a second position lower than the first position.

11. The sewing machine according to claim 10, wherein the introduction guide portion is located on the first preparatory path when the thread take-up lever is located at the first position, and the needle thread set along the first preparatory path is passed through the introduction guide portion of the thread take-up lever.

12. The sewing machine according to claim 10, wherein the introduction guide portion is located on the second preparatory path when the thread take-up lever is located at the second position, and when manually passed through the second preparatory path, the needle thread is caused to escape by the escape guide portion of the thread take-up lever so that the needle thread is prevented from being passed through the thread take-up lever.

13. The sewing machine according to claim 12, wherein the needle thread having been passed through the thread take-up lever is moved downstream relative to the second preparatory path by the escape guide portion of the thread take-up lever so that the needle thread is passed through a plurality of the thread guides and thereafter, the needle thread is further moved to the thread take-up lever side so as to be passed through the induction guide portion of the thread take-up lever.

14. The sewing machine according to claim 1, wherein the automatic threading apparatus includes a first thread transferring mechanism having a first thread transferring member transferring the needle thread set along the first preparatory path to a plurality of the thread guides including the thread take-up lever and a first driver driving the first thread transferring mechanism.

15. The sewing machine according to claim 2, wherein the automatic threading apparatus includes a first thread transferring mechanism having a first thread transferring member transferring the needle thread set along the first preparatory path to a plurality of the thread guides including the thread take-up lever and a first driver driving the first thread transferring mechanism.

16. The sewing machine according to claim 14, wherein the automatic threading apparatus includes a second thread transferring mechanism having a second thread transferring member transferring the needle thread located downstream relative to the thread take-up lever and a second driver driving the second thread transferring mechanism.

17. The sewing machine according to claim 15, wherein the automatic threading apparatus includes a second thread transferring mechanism having a second thread transferring member transferring the needle thread located downstream relative to the thread take-up lever and a second driver driving the second thread transferring mechanism.

18. The sewing machine according to claim 14, wherein the threading guides include a thread tension regulator disposed nearer to the thread supply than the thread take-up lever and a take-up spring disposed downstream relative to the thread tension regulator, and the first thread transferring mechanism is driven so that the needle thread set along the first preparatory path is transferred by the first thread transferring member thereby to be passed through the thread tension regulator and the take-up spring.

19. The sewing machine according to claim 15, wherein the threading guides include a thread tension regulator disposed nearer to the thread supply than the thread take-up lever and a take-up spring disposed downstream relative to the thread tension regulator, and the first thread transferring mechanism is driven so that the needle thread set along the first preparatory path is transferred by the first thread transferring member thereby to be passed through the thread tension regulator and the take-up spring.

20. The sewing maching according to claim 1, wherein the first preparatory path includes a first introductory groove, and the second preparatory path includes a second introductory groove.

* * * * *